US006272986B1

(12) United States Patent
Hess

(10) Patent No.: US 6,272,986 B1
(45) Date of Patent: Aug. 14, 2001

(54) RETRACTABLE IMPRESSION CYLINDER INKING/COATING APPARATUS HAVING FERRIS MOVEMENT BETWEEN PRINTING UNITS

(75) Inventor: Max W. Hess, Trophy Club, TX (US)

(73) Assignee: Howard W. DeMoore, Dallas, TX (US)

( * ) Notice: Subject to any disclaimer, the term of this patent is extended or adjusted under 35 U.S.C. 154(b) by 0 days.

(21) Appl. No.: 09/418,924

(22) Filed: Oct. 15, 1999

(51) Int. Cl.[7] ..... B41F 7/06; B41F 13/34; B41F 5/24

(52) U.S. Cl. ..... 101/137; 101/140; 101/145; 101/185; 101/218; 101/247

(58) Field of Search ..... 101/137, 140, 101/144, 145, 184, 185, 218, 247, 177

(56) References Cited

U.S. PATENT DOCUMENTS

| | | |
|---|---|---|
| 2,531,036 | 11/1950 | Goettsch . |
| 3,360,393 | 12/1967 | Rhorer . |
| 3,397,675 | 8/1968 | DeLigt . |
| 3,433,155 | 3/1969 | Norton . |
| 3,768,438 | 10/1973 | Kumpf . |
| 3,800,743 | 4/1974 | Egnaczak . |
| 3,916,824 | 11/1975 | Knodel et al. . |
| 3,931,791 | 1/1976 | Preuss et al. . |
| 4,222,325 | 9/1980 | Edwards . |
| 4,270,483 | 6/1981 | Butler et al. . |
| 4,372,244 | 2/1983 | Rebel . |
| 4,397,237 | 8/1983 | Makosch . |
| 4,399,767 | 8/1983 | Simeth . |
| 4,421,027 | 12/1983 | Fischer . |
| 4,446,814 | 5/1984 | Abendroth et al. . |
| 4,501,223 | 2/1985 | Matsuno et al. . |
| 4,524,712 | 6/1985 | Ito . |
| 4,569,306 | 2/1986 | Ito et al. . |
| 4,615,293 | 10/1986 | Jahn . |
| 4,685,414 | 8/1987 | DiRico . |
| 4,706,601 | 11/1987 | Jahn . |
| 4,779,557 | 10/1988 | Frazzitta . |
| 4,796,556 | 1/1989 | Bird . |
| 4,815,413 | 3/1989 | Kota . |
| 4,825,804 | 5/1989 | DiRico et al. . |
| 4,841,903 | 6/1989 | Bird . |

(List continued on next page.)

FOREIGN PATENT DOCUMENTS

| | | | | |
|---|---|---|---|---|
| 358099 | * | 10/1931 | (GB) | 101/247 |
| 2146291 | * | 4/1985 | (GB) . | |
| 64-53842 | * | 3/1989 | (JP) . | |

OTHER PUBLICATIONS

Herbert®, "Opti–Coat 2" Impression Coater, Brochure, 180 Linden Ave., Westbury, NY 11590, with 1991 copyright notice.

*Primary Examiner*—Daniel J. Colilla
(74) *Attorney, Agent, or Firm*—Locke Liddell & Sapp LLP

(57) ABSTRACT

A retractable impression cylinder coater printer known as the "Lithoflex I™" combines lithographic and flexographic printing and coating in a single pass operation. The apparatus is adapted for installation on any printing station of a multi-color lithographic press, and is not limited to the last printing station. Ink or coating materials are applied from a printing plate or a blanket mounted on the plate cylinder of the retractable printer-coater unit and applied directly onto the surface of a substrate passing over the impression cylinder of the lithographic printing station just after being lithographically printed on that station. The combination printed substrate is passed to the next or a following lithographic printing station where it is lithographically overprinted. The printer-coater parks in a location which provides operator access but is otherwise completely out of the way of the operator and does not hinder conventional use of the lithographic press on which the printer-coater unit is mounted.

69 Claims, 12 Drawing Sheets

U.S. PATENT DOCUMENTS

| | | |
|---|---|---|
| 4,852,515 | 8/1989 | Terasaka et al. . |
| 4,889,051 | 12/1989 | Sarda . |
| 4,934,305 | 6/1990 | Koehler et al. . |
| 5,107,790 | 4/1992 | Silker et al. . |
| 5,115,741 | 5/1992 | Rodi . |
| 5,176,077 | 1/1993 | DeMoore et al. . |
| 5,178,678 | 1/1993 | Koehler et al. . |
| 5,209,179 | 5/1993 | Hebert et al. . |
| 5,280,750 | 1/1994 | Yoshida et al. . |
| 5,598,777 | 2/1997 | DeMoore et al. . |
| 5,630,363 | 5/1997 | Davis et al. . |
| 5,651,316 | 7/1997 | DeMoore et al. . |
| 5,960,713 | 10/1999 | DeMoore et al. . |

* cited by examiner

RETRACTABLE IMPRESSION CYLINDER INKING/COATING APPARATUS HAVING FERRIS MOVEMENT BETWEEN PRINTING UNITS

BACKGROUND OF THE INVENTION

1. Field of the Invention

This invention relates generally to sheet-fed or web-fed rotary offset lithographic printing presses, and more particularly, to an improved printing and coating apparatus which combines lithographic and flexographic printing and coating operations and methods in a continuous in-line operation without the loss of a printing unit.

2. Background of the Prior Art

Offset lithography is a process well known in the art which utilizes the planographic method. Image and non-printing areas are essentially on the same plane of a thin metal plate and the distinction between them is maintain chemically. Ink is offset from a plate on the plate cylinder to a rubber blanket on a blanket cylinder and then from the blanket to a substrate supported on an impression cylinder on which printing occurs.

Conventional sheet-fed, rotary offset printing presses typically include one or more printing units through which individual sheets are fed and printed. After the last printing unit, freshly printed sheets are transferred by a delivery conveyor to the delivery end of the press where they are collected and stacked uniformly. In a typical sheet-fed, rotary offset printing press such as the Heidelberg Speedmaster line of presses, the delivery conveyor includes endless chains carrying gripper bars with gripper fingers which grip and pull freshly printed sheets from the last impression cylinder and convey them to the sheet delivery stacker.

Printed lithographic ink on the surface of the substrate sheet dries relatively slowly through oxidation and is easily smeared by subsequent transfer cylinders between the individual printing units of the press. Any relative movement of the freshly printed surface relative to a support surface can result in smearing. Modified and specialized equipment and techniques have been developed to combat this problem.

A related problem that is faced in the prior art is the problem of "offsetting" and "set off" of freshly printed ink at the delivery end of the press after the printed sheets are collected and stacked. A similar problem occurs in roll form material produced on a web-fed press. In some printing jobs, offsetting is prevented by applying a protective and/or decorative coating material over all or a portion of the freshly printed sheets. Some coatings are formed of an ultra-violet (UV)-curable or water-dispersed resin applied as a liquid solution over the freshly printed sheets to protect the ink from offsetting or set-off and improve the appearance of the freshly printed sheets. Such coatings are particularly desirable when decorative or protective finishes are applied in the printing of posters, record jackets, brochures, magazines, folding cartons and the like. In cases where coating is to be applied, the coating operation is carried out after the last printing unit, most desirably by an in-line coating application. It is highly undesirable to process the sheet through the press a second time in order to apply coatings, although this is sometimes done for special effects that are not otherwise obtainable.

The ability to overall coat, spot coat or print with aqueous, flexographic and UV curable inks and/or coatings in combination with lithographic, flexographic and waterless printing processes on a rotary offset printing press is highly desirable. Flexographic printing or coating with aqueous, flexographic and UV curable inks from a blanket or a relief plate can permit much heavier wet and dried ink film layers on the substrate. This is largely due to the nature of lithographic inks. Lithographic inks are generally oil based inks that are formulated to print from planographic surfaces based on the principle that oil and water do not mix. Lithographic inks are generally very strong in color value to compensate for the lesser amount that is printed. They are among the strongest of all inks. The average amount of ink transferred to the paper is further diluted by the double split of the ink film between the plate cylinder and the blanket cylinder and between the blanket cylinder and the substrate to be printed in the nip between the blanket cylinder and the impression cylinder. In many situations, only a quarter of the film thickness on the plate is transferred to the substrate. This can make it difficult to obtain sufficient opacity with white or metallic (gold, silver or other metallic) ink or in printing specialized vehicles such as "scratch-and-sniff" materials from a slurry containing encapsulated essence. This often mean that sheets or substrate must be removed and transferred to a second type of machine using the flexographic process to apply greater amounts of ink thickness and make successive or two passes to achieve desired print quality.

The prior art has attempted to solve these problems and obtain higher applied film weights in a variety of ways. It is known to provide a printing machine with a downstream coating station having a blanket roller coater associated with a coating application unit for application of a protective coating over the entire printed area of copy sheets or web before they go to the stacker. Jahn, U.S. Pat. Nos. 4,615,293 and 4,706,601 disclose separate duplex coating units disposed downstream of a printing press. These permit coating selected portions of the substrate using a relief plate and they permit blanket coating.

A number of coating units are known which are appended to or mounted upon the final printing station in the press. Most of these coating units prevent of the printing unit on which it is mounted from doing its normal printing function resulting in the loss of one printed color. A four color press using such a coating apparatus would permit printing only three colors in line in a single pass operation because the last station is converted to a flexographic printer-coater. Bird U.S. Pat. Nos. 4,796,556 and 4,841,903 disclose a liquid application station for the final downstream printing station which converts the lithographic station to a printing coater or a continuous film coater by moving a carriage having a coating unit into impression with the plate or blanket cylinder of the last station on the press. When the coater is used, the normal lithographic printing function on that station is inoperative. DiRico, U.S. Pat. No. 4,685,414 discloses a process and apparatus in use in combination with the last station of an existing offset lithographic press where the coating means is retractable to be used or not as a printer requires. Since the DiRico coater utilizes a blanket cylinder on the last unit of the press, this last unit cannot be used for color printing when it is used for coating. DeMoore, et al., U.S. Pat. No. 5,651,316 discloses a retractable printer-coater unit which though not limited to the last printing station of an offset lithographic press, is useful for lithographic or flexographic printing when the ordinary lithographic operation of the station in which it is mounted is not being used. The lithographic operation of the station is lost when this printer-coater is in operation. Sarda, U.S. Pat. No. 4,889,051 illustrates a retractable lithographic printing unit which does not disable normal lithographic printing on the lithographic printing station. It enables printing another lithographic color at a station by adding a second blanket roller and a retracting inked and dampened applicator for the second blanket roller of the printing station.

Koehler, et al., U.S. Pat. Nos. 4,934,305 and 5,178,678 disclose a flexographic liquid film applicator unit which employs a special "blanket" cylinder which engages the substrate on the impression cylinder of the last lithographic printing station on a multi-color lithographic press. The unit slides in and out on "inclined tracks". Manual reengagement and registration of a drive gear on the applicator with a press drive gear using "index" marks is required to reset the applicator "blanket" cylinder after the unit has been moved away from the printing station.

DeMoore, et al., U.S. Pat. No. 5,176,077 is a delivery cylinder coater for use on the final printing station of a lithographic printing press. The delivery cylinder is provided with a coating blanket. A flexographic applicator roll applies liquid coating to the delivery cylinder as it rotates into the freshly lithographically inked surface of the sheets coming off the press. The coating pickup anilox roller frictionally engages the surface of the delivery cylinder and is rotated by a hydraulic motor.

Such apparatus provided by the prior art has a number of advantages and disadvantages. Retrofitting existing presses is often difficult because of space considerations. A dedicated coating unit is often not possible because of space considerations and involves press downtime and substantial capital costs. Devices that utilize the print cylinder or blanket cylinder of the press limit the ability of that station to lithographically print in the normal manner. In retrofitting presses, space considerations are a major problem, especially the space between printing units.

Coaters which utilize the plate cylinder or the blanket cylinder of the printing station still suffer from the disadvantage that the coating is split which reduces the wet film thickness that can be applied to the substrate itself. A few add on coating units that print directly on the substrate on the impressions cylinder or a transfer cylinder are limited to the last printing station on the press where there is more room for installation. Such equipment can be moved away or the operator can do the make ready work on the opposite side of the last printing station in the conventional work space for the operator. If such equipment is mounted in the interstation space on a lithographic press, the equipment interferes with operator access to the next station.

It is preferable not to have to cut into press frame to gain access to the main gears and not to have to manually engage and disengage indexed gear teeth of gears on the coater with gears on the press. The ability to flexographically coat, spot coat or print on the substrate at an intermediate printing station with an apparatus that parks completely out of the way, which permits coating on the substrate just after it has been lithographically printed on the same impression cylinder, can apply a full coating thickness directly to the substrate, does not require modifying the press drive or cutting into the press gears, and permits further lithographic printing or perfecting on the next or following stations would be highly desirable. The present invention is able to fulfill these needs and more.

SUMMARY OF THE INVENTION

The invention comprises a method and apparatus for establishing and operating printing equipment on a lithographic press which combines lithographic and flexographic printing. The lithographic printing is done in the usual manner on an offset lithographic printing press having a plurality of successive offset lithographic printing stations having an impression cylinder and a substrate path for a succession of substrates printed in the nip between the impression cylinder and blanket cylinder of each printing station. The flexographic printing aspect is provided by the apparatus of the invention which direct prints the substrate on an impression cylinder of the conventional lithographic printing station. The invention is a retractable printer-coater which can be mounted on any printing station of a lithographic press.

The printer-coater has a printing head or printhead comprising a plate cylinder having a printing surface thereon mounted in a frame in operative combination with a roller mechanism and ink supply for applying a controlled layer of printing liquid to the printing surface. The printhead has a main frame and a secondary frame on which the plate cylinder is mounted. The secondary frame pivots relative to the main frame to move the plate cylinder into and out of impression with the impression cylinder of the press printing station. In a preferred environment the printer head has an encoder controlled servomotor and control system driving the plate cylinder of the printing head in registration with the impression cylinder of the lithographic printing station on which it is mounted. In an alternate embodiment the printer head is driven by gears which engage a register printing gear on the press. There is a shock absorbing spring link connection which allows the plate cylinder to be forced in an off impression direction if excessive force is imposed in the contact area between the plate and the impression cylinders.

A retraction mechanism mounted on the printing station of the press is coupled to the printing head for movement between a storage position and an operating position of the printing head. When in the operating position, the plate cylinder of the printing head is movable between an off and on impression condition with substrates on the impression cylinder of that station. Substrates are conventionally lithographically printed on the station and before the substrates come off the impression cylinder are register printed or have a spot coating or overall coating applied to the lithographically printed surface by the printer-coater of the invention. The substrates are then dried and moved onto a successive printing station where additional lithographic printing is performed on the substrates.

The control unit for registering the printing surface of the printing head with the impression cylinder comprises an encoder which monitors rotational position and speed of the lithographic press, in combination with a controller and encoder controlled drive motor which drives the printing head plate cylinder to match the speed of rotation and angular rotational position of the plate cylinder relative to the impression cylinder. The control unit preferably includes a safety feature to preclude damage in the event register control of the plate cylinder relative to the impression cylinder should fail. A constant voltage signal is provided when the plate cylinder is running in register with the impression cylinder. If register is lost, that signal is altered, and that alteration triggers a pneumatic safety system that immediately moves the plate cylinder off impression without any involvement of the operator.

The printing head is supported by arms of the retraction mechanism that raise and lower the printing head. The printing head is mounted on a main frame connected to the arms of the retraction mechanism and has a movable secondary frame which carries the plate cylinder and an anilox roller mechanism for applying a controlled layer of printing liquid to the printing surface. The secondary frame pivots relative to the main frame in response to an activator which moves the plate cylinder on and off impression with the impression cylinder of the lithographic printing station. The printing head locks onto the press frame in the operative position and unlocks for retraction. A positioning device in the retraction mechanism has the ability to cant the printing head forward or backward as it is being raised or lowered to miss parts of the printing station and to move the printhead into a more favored position for access by the operator when it is in the parked storage position. A controlled drive unit which moves the arms of the retraction mechanism includes a drive motor which varies the rotational speed of a shaft which moves the arms and thereby enables the speed of movement to be slowed down as it approaches the end of its travel. The speed control includes cams which turn when the arms are raised and switches which ride the cams to slow the drive motor and/or stop the drive motor when the printhead reaches either of its extreme positions. Limit switches are also employed to prevent the printhead from moving too far.

The printing surface on the plate cylinder of the printhead may be a smooth blanket or a relief plate designed to apply images directly to the substrates on the impression cylinder. The relief plate is preferably a flexographic plate and the printing liquid a flexographic ink. The printer-coater is advantageously used for register printing as well as spot coating or overall coating the substrate.

When used on a perfecting press ahead of the perfecting apparatus, the printer-coater of the invention can advantageously provide an overall protective or decorative coating to the lithographically printed surface just before it is reversed for printing on the opposite side. Such coating can protect the freshly printed surface from smudging or smearing or offsetting as it travels through the remaining stations on the perfecting press.

The invention can be applied to one or more of the lithographic printing stations on a multi station press to provide additional coating or printing capabilities. Such stations can register print successive substrates on the impression cylinder of a station on the lithographic press without affecting the capability of that press station to print the succession of substrates by conventional offset lithography and without affecting the downstream lithographic printing stations which can print over the lithographic or flexographically printed surface of the substrate. Preferably an infrared interstation high velocity dryer/extractor is employed to facilitate removal of moisture from aqueous based inks or coatings before they are printed by the next printing station. The printer-coater provides the capability of offset lithographically printing a surface of a series of substrates or a substrate web in a printing station of the press, applying an overcoating directly to the lithographically printed surfaces by means of the printing head as they are passing over the impression cylinder, drying the overcoating applied by the printing head and printing the substrates on another printing station after they are dried. A suitable infrared dryer for this purpose is disclosed in U.S. patent application Ser. No. 09/240,789 filed Jan. 27, 1999, and assigned to Howard W. DeMoore, which is incorporated herein by reference.

When the plate cylinder of the printing head is provided with a flexographic plate and ink, the step of over-printing with the printing head comprises the step of applying flexographic ink or coating images directly onto the surfaces of the substrates as they are supported on the impression cylinder. It is also believed to be advantageous to employ an infra-red forced air dryer at the end of the press with the inventive printer-coater such as disclosed in U.S. Pat. No. 5,537,925 entitled Infra-Red Forced Air Dryer and Extractor which is assigned to Howard W. DeMoore and incorporated herein by reference.

As an aid to understanding as used herein, the term "substrate" refers to sheet and web material suitable for printing. The term "ink" or "printing liquid" or the like is to be considered as a general term in the context in which it is used to include printing inks and coatings. "Lithographic ink" will refer exclusively to the normal conventional strong oil based inks that are used in an offset lithographic press. The general term "ink" can include material with or without pigments, vehicles, diluents or binders and as such can include what may normally be understood as coatings that are usually considered to contain film forming vehicles dissolved in solvents and diluents. The term "lithographic printing" or the like can include "waterless" lithographic printing in which the normal dampening system is not used. The term "flexographic" refers to a printing or coating technique or process, other than the conventional offset lithographic printing process which employs dampening and inking to produce an image. "Flexographic" as used herein means the application of a liquid film of printing liquid to a printing surface on the plate cylinder of the printhead, without the need for conventional dampening with aqueous materials, whereby a wet film or wet image is transferred directly to the substrate from the printing surface. The term "relief plate" is intended to refer to any printing plate having "raised" areas relative to other areas on the printing surface of the plate which are designed to print or apply ink/printing liquid from the raised surfaces. A relief plate can include a "flexographic plate" which refers to a flexible printing plate having a relief surface which is wettable by flexographic ink or coating materials. Flexographic printing ink is a species of ink or coating material having a base constituent which is soluble in water, alcohol or special solvents that are compatible with rubber or polymeric plates. Some flexographic printing plates are made from polymeric materials, such as plates sold under the trademark CYREL®) by E.I. duPont de Nemours of Wilmington, Del., U.S.A. The term "printing surface" is intended to include relief plates as well as a smooth surfaces such as provided by a blanket which can be used on the printhead to produce an overall coating when used in combination with the printer-coater. The term "perfecting", "perfecting apparatus" and "perfecting press" refer respectively to the process of turning the sheet part way through the press so as to print on both sides of the sheet, the apparatus which turns the sheets in the press and a press which prints first on one surface and then on the opposite surface in one pass through the machine. The terms "upstream" and "downstream" are used with respect to of the flow of sheets moving through the press from right to left in FIG. 1. An "encoder" is an electrical and/or optical "servo-system" which monitors position and speed of a rotating part and in combination with a controller, operates a servomotor or stepping type motor that controls the position and speed of a different rotating part, without a direct mechanical drive connection between the monitored part and the controlled part.

DETAILED DESCRIPTION OF THE INVENTION

Figure 1:
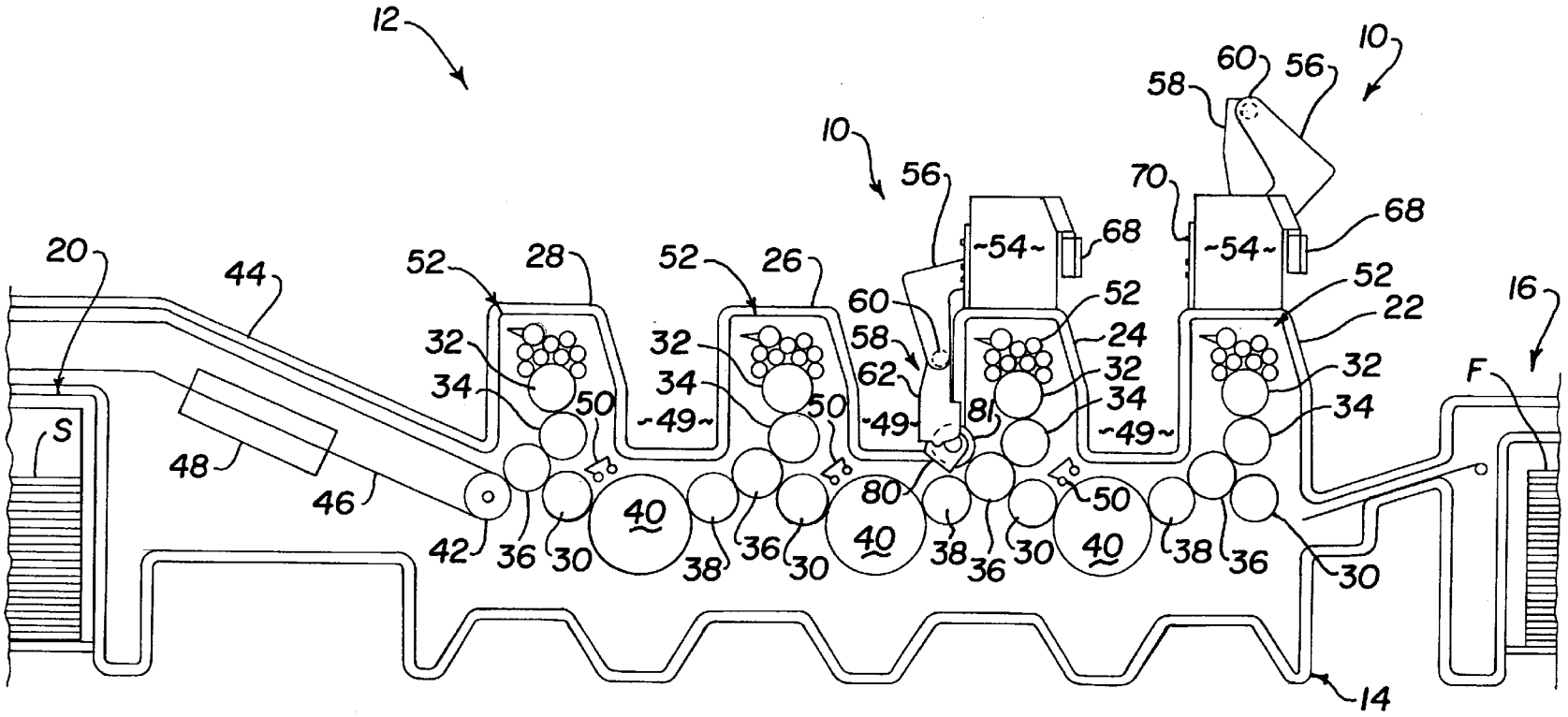
FIG. 1 is a side elevation view of a sheet fed, rotary offset printing press having a sheet feeder on the right side and a delivery end and stacker on the left wherein the apparatus of the present invention is seen in the parked position mounted on the first printing station and a second printer-coater of the invention is shown in the operating position mounted on the second printing station of the press.

As shown in FIG. 1, the present invention is embodied in a new and improved in-line printer-coater referred to generally by the reference numeral 10 and offered by Printing Research, Inc. of Dallas, Tex. under the name "LITHOFLEX I™". As will be seen, the LITHOFLEX I™ is an impression cylinder printer-coater which can overall or spot coat and flexographically register print directly on a substrate passing over the impression cylinder of a lithographic printing station. The LITHOFLEX I™ is adapted to flexographically apply aqueous, flexographic or UV-curable inks, directly on the surface of sheets or webs printed in a sheet-fed or web-fed, rotary offset printing press, generally designated by the reference numeral 12. As exemplified in FIG. 1, the printer-coater 10 is shown installed between the first and second and between the second and third printing stations of a four unit rotary offset printing press 12 of conventional design, such as manufactured by Heidelberger Druckmachinen AG of Germany under its designation Heidelberg Speedmaster SM102 (40 inch, 102 cm).

Press 12 includes a press frame 14 coupled at the feed end, herein the right side of FIG. 1, to a sheet feeder 16 from which sheets designated F, are sequentially fed into the press and processed for printing along a serpentine substrate path for printing established by the press designer. At the delivery end of the press, a sheet delivery stacker 20 is connected for collecting and stacking the freshly printed sheets now labeled "S." Four substantially identical lithographic sheet printing stations 22, 24, 26 and 28 can collectively print four different colors onto the sheets as they are transferred through press 12. The printing stations are housed within towers extending between side frames of the press.

The LITHOFLEX I™ units are preferably mounted on top of these towers, as indicated, without substantial modifications to the frame of the press. Each exemplary printing station 22, 24, 26, 28 has a plate cylinder 32, blanket cylinder 34, impression cylinder 36 and in-feed transfer cylinder 30 rotatably mounted in the frame of the press. The first three lithographic printing stations include a transfer cylinder 38 disposed to transfer the freshly printed sheets from the adjacent impression cylinder to the next printing unit via an intermediate transfer drum 40. The last printing unit 28 includes a delivery cylinder 42 leading to a conventional delivery conveyor system 44 which transfers printed sheets "S" to the stacker by means of a pair of endless delivery gripper chains 46 having conventional gripper bars and gripper fingers which grip and pull the leading edge of freshly printed or coated sheets successively between impression cylinder 36 and delivery cylinder 42. The individual sheets are carried through the press by similar gripper chains (not shown) as is conventional. Prior to reaching the stacker, the freshly printed sheets may pass through a delivery dryer 48 which combines infrared thermal radiation with high velocity hot air flow in a heat and moisture extractor for drying the ink or coating on the surface of the sheet as disclosed in U.S. Pat. 5,537,925 sold by Printing Research, Inc. of Dallas, Tex. under the trademark AIR-BLANKET™. A number of other dryers and/or extractors 50 may be used at various locations along the substrate path.

Each of the printing stations on lithographic press 12 may include a conventional inking and dampening apparatus indicated schematically by the reference numeral 52. A conventional lithographic inking and dampening apparatus is needed to perform lithographic printing. The LITHOFLEX I™ printer-coater apparatus installed on the first and second stations of press 12 include a housing 54 mounted across frames 14 from the drive side to the operator side of the press. Housing 54 supports a retraction mechanism adapted to raise and lower a pair of arms 56, one on each side, which supports a flexographic printing head 58 through a pivotable joint 60. Joint 60 preferably is in the form of a torque tube 78.

Pivoting head 58 includes a main frame 62 and a secondary frame 80 which carries a register controlled electrically driven plate cylinder 81. Also shown is an electrical control box 68 and a control panel 70 for the operator. Some controls may be split between the control panel and control box for convenience of the operator. The LITHOFLEX I™ printer-coater is shown parked in the storage position on the first station and lowered into the operating position with the printing cylinder of the head in impression with the impression cylinder of the second lithographic printing station 24. An operator access space 49 is provided between printing stations on the press to allow the operator to stand and work between printing stations. Of particular interest is the complete and utter freedom the operator has in operating the lithographic press in the conventional manner when the printer-coater of the present invention is stored in the parked position completely out of his way. This, together with the fact that the LITHOFLEX I™ is specially adapted to fit into the constricted space between printing stations, makes it possible to use the invention on any station of the press.

Figure 2:
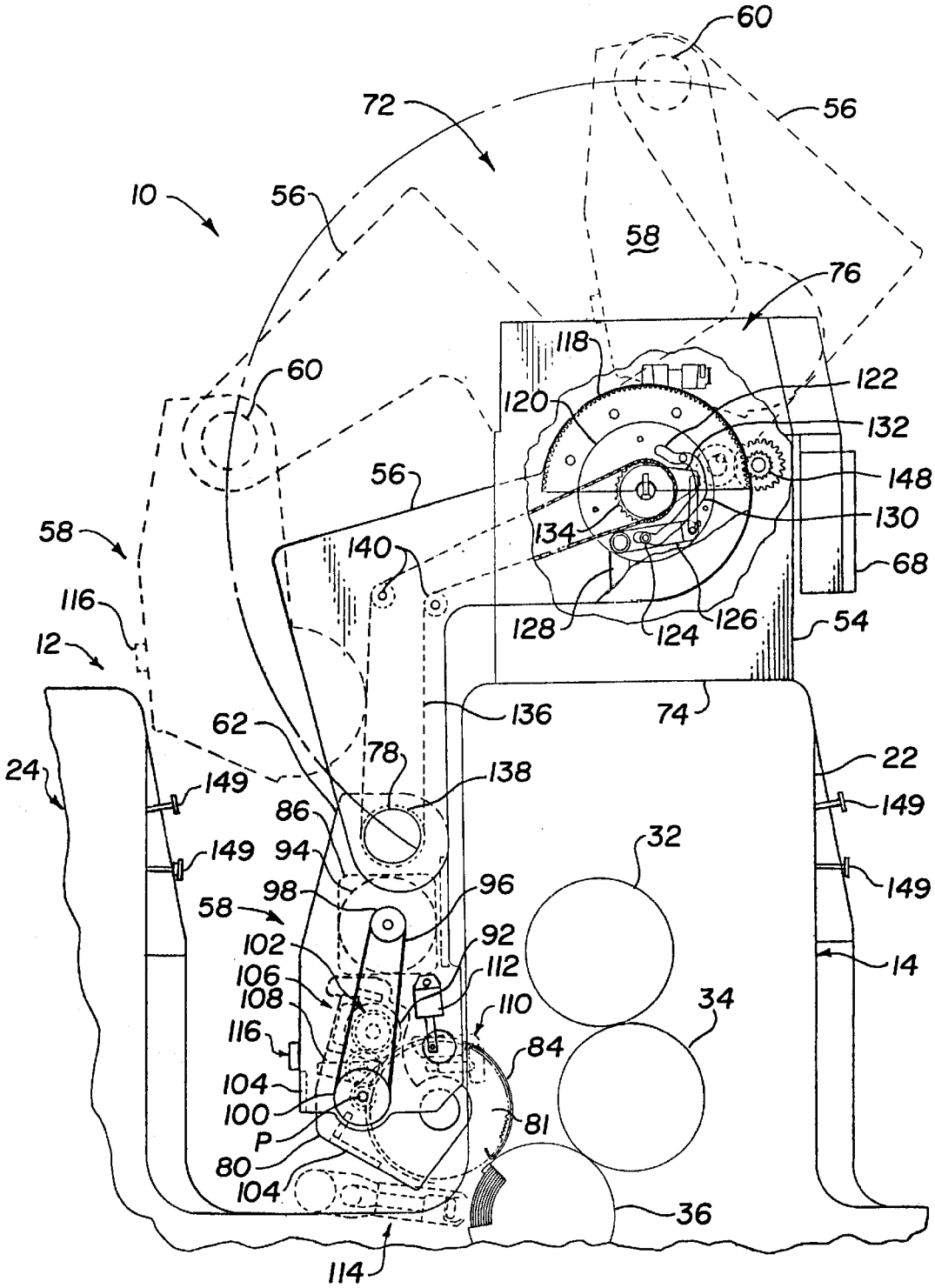
FIG. 2 is a side view showing more details of the printer-coater of the present invention, shown in solid lines in the operating position and in dotted outline as it moves first to an intermediate position and then to a parked position where it is stored.
Figure 3:
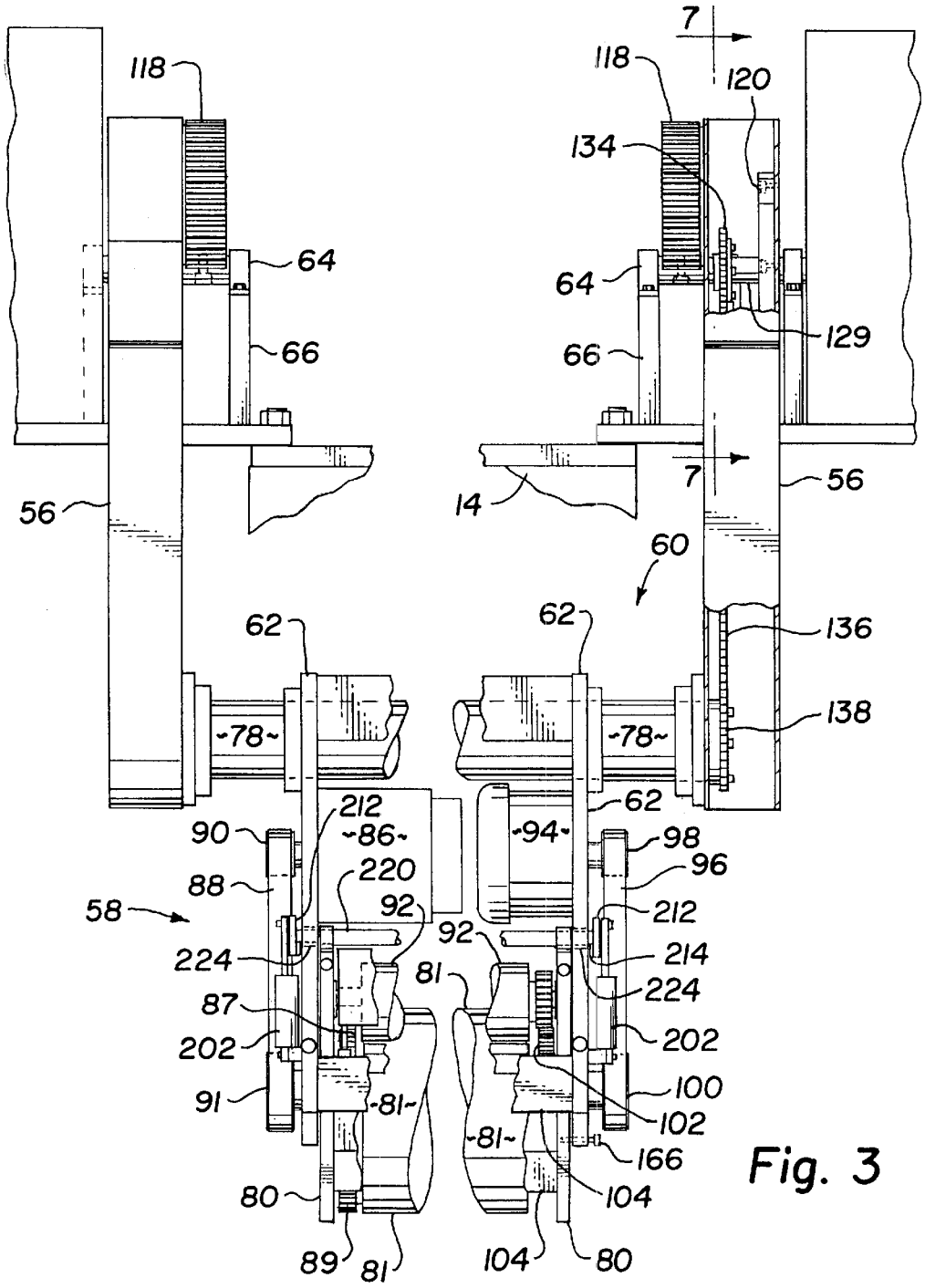
FIG. 3 is an elevation view of the printer-coater in the operating position of FIG. 2 without showing the press cylinders.

FIGS. 2 and 3 are respectively a side view and a view from behind looking toward the front of the press, of the LITHOFLEX I™ printer-coater such as installed on first and second printing stations 22 or 24 of exemplary lithographic printing press 12 in FIG. 1. Press 12, as is conventional, has what is referred to as an operator side and a drive side. FIG. 2 is looking at the printer-coater installation from the operator's side looking toward the drive side. This puts the operator side on the right side of FIG. 3 looking towards the feed end of the press. Printer-coater 10 has a retraction mechanism generally designated by reference numeral 72. The LITHOFLEX I™ apparatus is mounted on the top of frame 14 of any one of the printing stations, here indicated as printing station 22. Press 12 generally has two main side frames which are connected laterally by various supports and housing structure that protects the printing stand. The conventional inking and dampening apparatus 52 has been excluded from FIG. 2 for clarity.

Retraction mechanism 72 has a supporting housing 54 conveniently mounted on the top 74 of frame 14. A drive assembly generally referred to by reference numeral 76 is supported and contained in housing 54 for raising and lowering the "L"-shaped arms 56 which pivotally support printing head 58. In FIGS. 2 and 3, printing head 58 is shown to be essentially self contained.

Main frame 62 and secondary frame 80 are preferably made from plate. Main frame 62 is fixedly mounted on pivotal point joint 60 comprising torque tube 78. Main frame 62 pivotally and laterally slidably supports secondary frame 80. Secondary frame 80 is pivoted with respect to main frame 62 at pivot point "P" A plate cylinder 81 is supported for rotation on secondary frame 80 in register with impression cylinder 36 of the lithographic printing station. In FIG. 2, a printing plate 84 having a printing surface is mounted for printing on printing cylinder 81 in registration with impression cylinder 36. Frame 80 pivots at point "P" in order to move plate cylinder into and out of impression with press impression cylinder 36. In FIG. 3 an encoder controlled drive motor 86 (servomotor) on frame 62 turns a timing belt 88 through pulleys 90,91 which positively drives print cylinder 81. Pulley 91 is connected to gears 87 shown hidden in FIG. 2 which engage corresponding gear 89 on plate cylinder 81. Encoder controlled drive motor (or servomotor) 86 is indicated by the square dotted outline on FIG. 2.

An anilox roller 92 is driven by a variable speed motor 94 through timing belt 96, running over pulleys 98 and 100. A set of intermeshing gears 102 comprise a gear train which turn the anilox roll in the proper direction in response to movement of timing belt 96 and pulleys 98, 100. These gears are seen in dotted outline in FIG. 2. Some rectangular supports 104, seen in FIGS. 2,3, and 6 run laterally across printing head 58 to connect the side pieces 62 of the main frame and side pieces 80 of the secondary frame. Anilox roll 92 seen in dotted outline behind the frame in FIG. 2 includes an ink reservoir of the closed type which is generally referred to by the reference numeral 106. This may be of the type disclosed in U.S. Pat. No. 5,425,809 assigned to Howard W. DeMoore, the disclosure of which is incorporated herein by reference. A drip pan 108 shown in dotted outline in FIG. 2 may be used to catch any leakage of ink from ink reservoir/applicator 106. An ink supply pump and fluid conduit lines are not shown. The anilox roller will be discussed further in the subsequent discussion of FIGS. 5 and 6.

A locking mechanism generally referred to by the reference numeral 110 is shown in dotted outline in FIG. 2 along with an operating air cylinder 112 which is shown on the outside of the frame in solid line. There are preferably two of these, one on each side. The locking mechanism will be explained in the discussion of FIG. 8. A high velocity hot air and/or infrared dryer and moisture extractor referred to generally by reference numeral 114 is seen facing the sheets that will be coming out of the nip between printing cylinder 81 and impression cylinder 36. Even in the short span available before the freshly inked surface reaches the next transfer cylinder 38, such a dryer-extractor extending laterally across the printed surface can be effective for removing moisture and drying the surface of the substrate, especially when inks having an aqueous content are employed. On stop adjusters 116 are used to limit the impression of cylinders 81 and 36 as seen better in FIG. 6.

Figure 4:
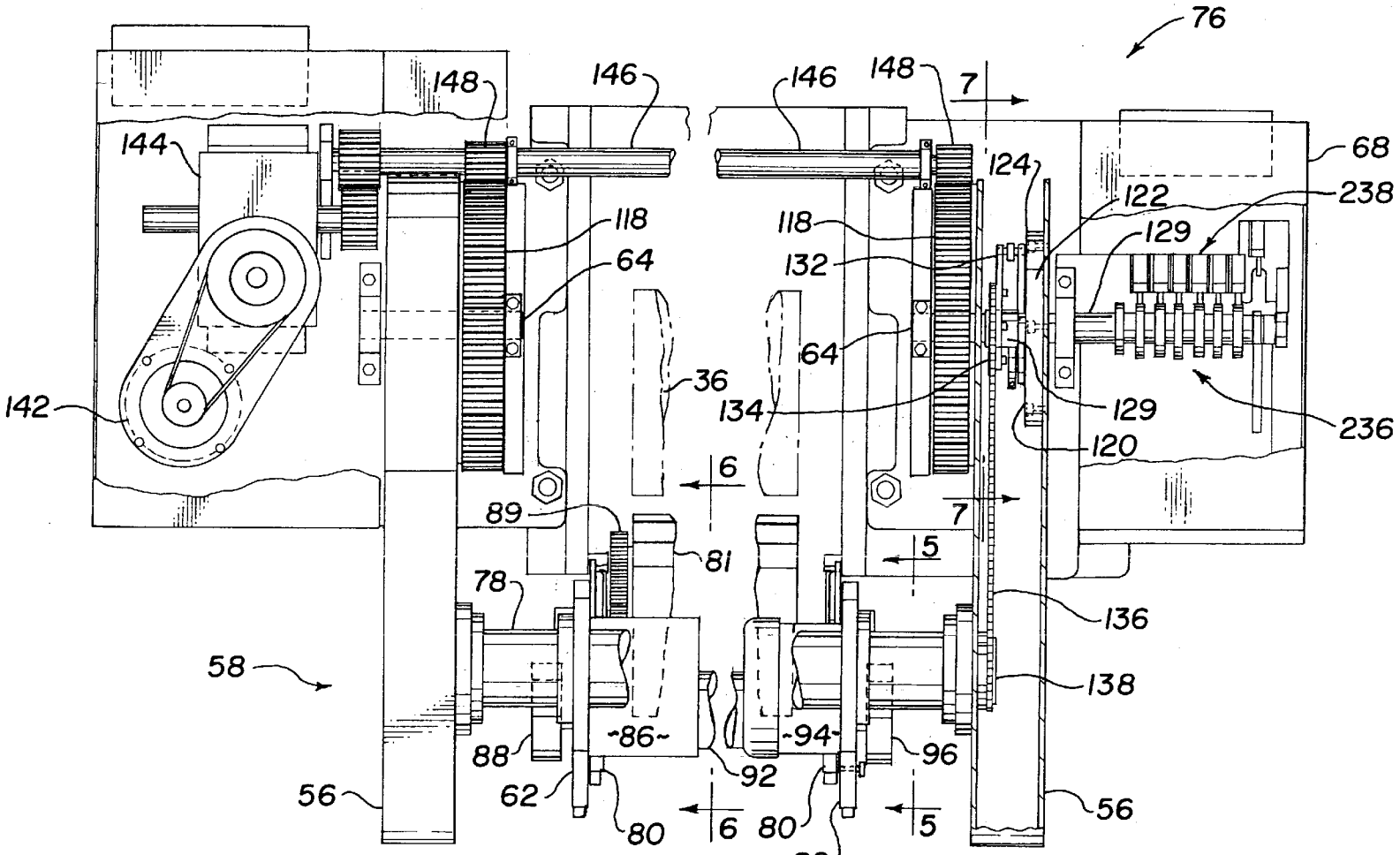
FIG. 4 is a top view in somewhat greater detail of the printer-coater of FIG. 3, showing the drive unit for the arms that support and raise the printing head.

Retraction mechanism 72 and its drive assembly 76 is best seen in FIGS. 2, 3 and 4. In FIG. 2, half-gears 118 are fixed to the drive side arm 56 and the operator side arm 56. A cam plate 120 is also fixed by bolts to one of the arms 56, for example, as shown in FIG. 4. Cam plate 120 contains an irregular cam surface 122 (slot) for a cam follower 124 mounted on a pivoting bar 126 which has one end pivotally connected to a fixed support 128. Pivoting bar 126 has a link 130 pivotally connected to its outer end. Link 130 is pivotally connected to an arm 132 which is fixed to the sprocket 134. Sprocket 134 is fixed to arm 132 but not fixed to shaft 129, and therefore does not rotate along with half-gears 118. Sprocket 134 is connected to a sprocket 138 through an endless chain 136, which as seen in FIG. 3, is bolted to torque tube 78. Torque tube 78 is fixed to main frame 62 and serves to apply a torque to printhead 58.

Chain 136 is conveniently mounted within the operator side lifting arm 56 guided by idler sprockets 140. Drive motor 142 for the retraction mechanism drive 76 turns the output shaft of a reduction gear box 144. The output of gear reducer 144 turns a drive shaft 146 having gears 148 which turn half-gears 118 in response to controls given by the operator through the control box to raise or lower the arms. It can be seen that when the arms begin to raise, cam follower 124 remains stationary while the cam plate rotates with the arms 56 as they move upward. Cam follower 124 moving in cooperation with the moving cam surface 122 toggles the sprocket 134 a sufficient amount to cant printhead 58 forwardly in the direction of the feed end of the press such that it can pass upwardly and downwardly without striking parts of the next printing station, such as control knobs 149, as it moves into and out of the operating position. The printhead can be canted in either direction in order to clear press guards and other parts as it moves up and down. The cam slot is also adapted to cause printhead 58 to swing out toward the front of the press as it reaches the park position to make it easier for the operator to reach the plate cylinder.

An additional feature of drive unit 76 is an electromechanical mechanism to alter velocity of movement of arms 56 as they rotate between the storage position and the operating position of printhead 58. Shaft 129, also seen in FIGS. 3 and 4, is supported in bearing blocks 64. Half gears 118 are fixedly attached to shaft 129 and supported on support stands 66 which are supported by press frame 14. Shaft 129 extends outwardly from arm 56 and is provided with multiple cams 136 which cooperate with multiple switches, preferably on/off switches, which are electrically tied into the control for drive motor 142 that raises and lowers the arms. Drive motor 142 is a variable speed motor which is controllably operated by the positioning of the switches in response to the rotational position of shaft 129 in contact with cams 236. Drive motor 142 is stopped at the end of travel position of the printhead. The speed of movement at the extreme ends of the movement is altered so that the printhead moves into and out of position slowly but can be moved at a more rapid rate at intermediate positions between operating and storage locations. This control system is of conventional design. The system provides a smooth operation without jolting the equipment because of sudden acceleration or deceleration.

Figure 5:
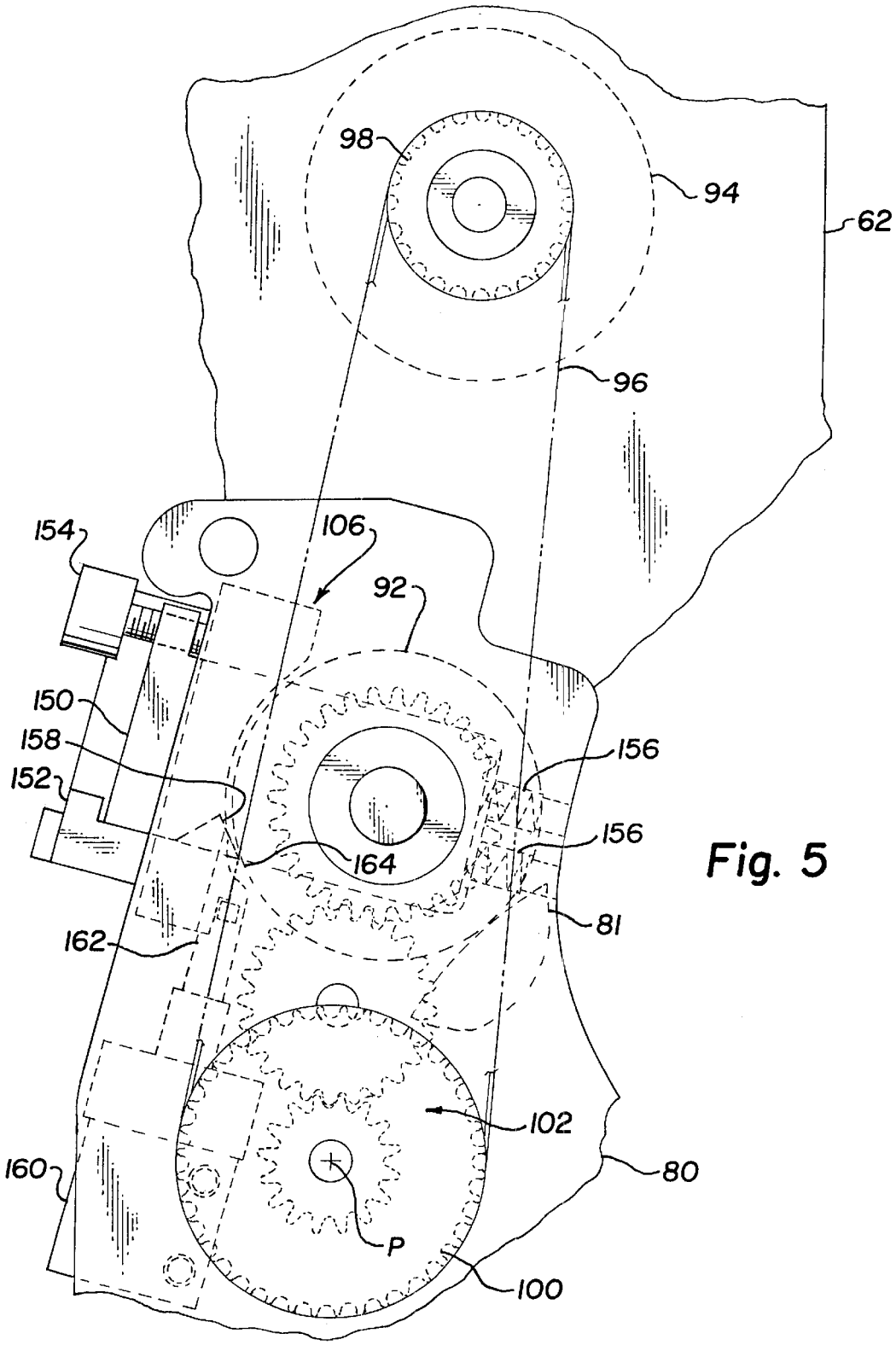
FIG. 5 is a cut away side view along the lines 5—5 of FIG. 4 which shows one of the operating mechanisms which drive and engage the anilox roller of the printer-coater with its printing cylinder on the printing head.

FIG. 5 schematically illustrates a means for positioning anilox roller 92 in printing liquid transfer impression with partially shown plate cylinder 81. Round variable speed electric motor 94 is schematically shown driving pulley 98 and pulley 100 via timing belt 96. Pulley 100 is drivingly connected to gear train 102 which rotates anilox roller 92. A sliding block 150 is mounted in a housing 152 for movement to and fro on secondary frame 80. Anilox roller 92 is journaled in the sliding block. An adjustable stop 154 strikes frame 80 and prevents sliding block 150 from moving any further in the direction of plate cylinder 81. This provides a repeatable stop. Ink reservoir 106 is preferably mounted to move with the sliding block so as to maintain its relationship with anilox roller 92. Springs 156 which can be provided with a mechanical adjustment, press against sliding block 150 with sufficient force to move anilox roller 92 off impression. Sliding block 150 also includes camming surface 158. Operator controllable air cylinder 160 moves an operating rod 162 having a cam 164, which when extended, rides camming surface 158 to drive sliding block 150 forward until stop 154 engages frame 80. Both ends of the anilox roller 92 are supported in this manner by this structure to adjustably move the anilox roller between an on impression and off impression position with respect to plate cylinder 81 of printing head 58. Only a portion of this apparatus is shown in FIG. 6.

Figure 6:
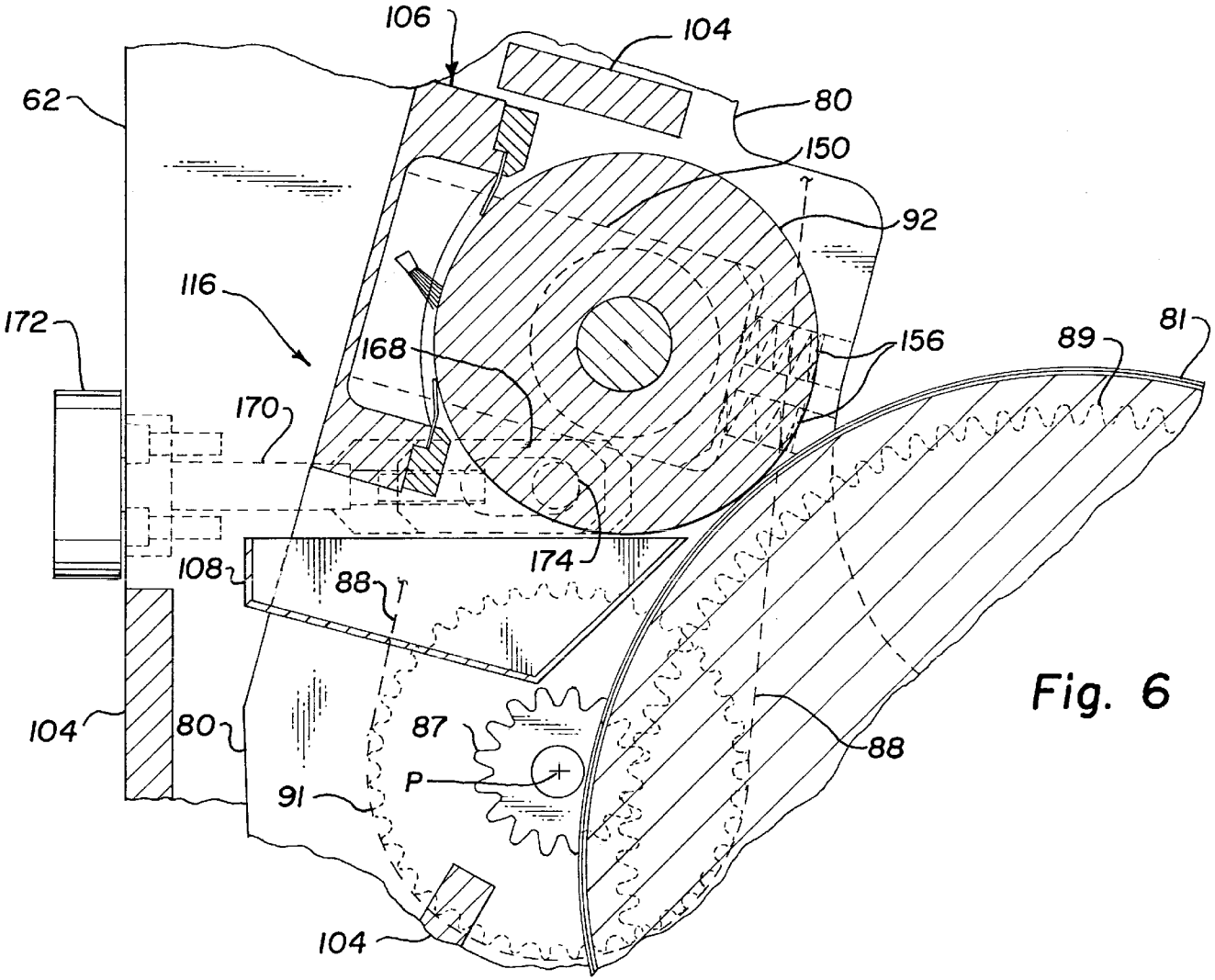
FIG. 6 is a cut away side view along the lines 6—6 of FIG. 4 showing the drive for the printing cylinder of the printer-coater, the adjustable on stop, and the metering anilox roller together with its enclosed ink supply.

An on-stop apparatus 116 for plate cylinder 81 and some of the other components mounted on movable secondary frame 80 are schematically shown in FIG. 6. FIG. 6 illustrates that the pivot point "P" indicated by an X is the point at which secondary frame 80 is pivotally mounted on main frame 62. The shaft on which pulleys 91 and 100 are mounted is journaled in main frame 62 as shown in FIG. 3. It passes through both sides of the frame, where it is journaled to pivotally support frame 80. The assembled frame 80 is slightly smaller in the width direction than main frame 62. The journals at pivot point "P" allow a small amount of lateral sliding of secondary frame 80 with respect to main frame 62 in order to provide for lateral movement required for side registration of print cylinder 81 with respect to impression cylinder 36. The plate cylinder is also preferably provided with pin registration. A lateral registration adjustment device 166 schematically seen in FIG. 3 mechanically controls the small amount of lateral movement that may be needed for lateral registration. The mechanism for pivoting frame 80 relative to frame 62 is discussed in connection with FIG. 9.

In FIG. 6, a movable sliding bracket 168 is threadedly connected to shaft 170 and mounted together with adjustment knob 172 on main frame 62. A pin 174 fixed to secondary frame 80 serves as a stop in cooperation with an opening in movable bracket 168. This apparatus positively and adjustably limits travel of the plate cylinder 81 when it goes on impression with impression cylinder 36 of the printing station 22 on which the apparatus is mounted. There is one on each side of printhead 58.

Figure 7:
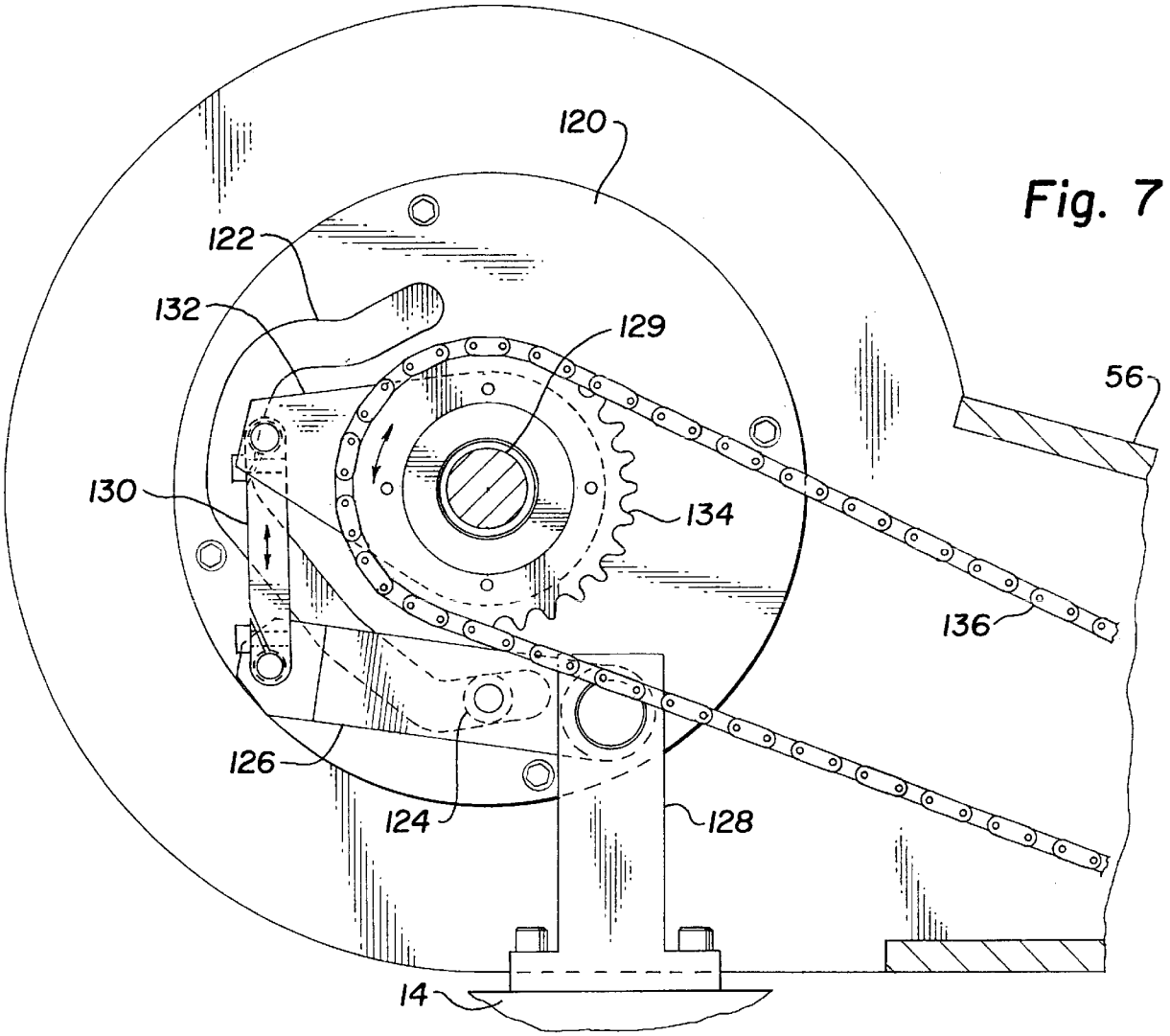
FIG. 7 is a cut away side view along the lines 7—7 of FIG. 4 showing a mechanical control mechanism used to cant the printing head as it moves from the operating to the storage position on a printing station of the press.

FIG. 7 is an enlarged view of the main components of the mechanism within retraction mechanism and drive assembly 72, 76 viewed from the opposite side from that of FIG. 2 on lines 7—7 of FIG. 4. Cam plate 120 is seen bolted to the operator's side lifting arm 56 mounted on the top of press frame 14. An irregular cam slot 122 is provided in cam plate 120 for cam follower 124. Cam follower 124 is fixedly mounted on pivoting bar 126 having one end pivotally mounted on fixed support 128. Link 130 is pivotally connected at one end to the outer end of bar 126 at the other end to arm 132. Arm 132 is fixed to sprocket 134 which moves chain 136 and torque tube 78. Sprocket 134 is non-fixedly mounted on shaft 129 so that the sprocket turns only in response to the movement of the cam as the cam plate turns with arm 56. Sprocket 134 does not rotate with the arm itself. This mechanism causes the printing head 58 hanging from pivot 60 on arms 56 to be controllably tilted or canted backwards and forwards as it is raised and lowered into position in the limited space between the printing station on which it is mounted and the following station.

Figure 8:
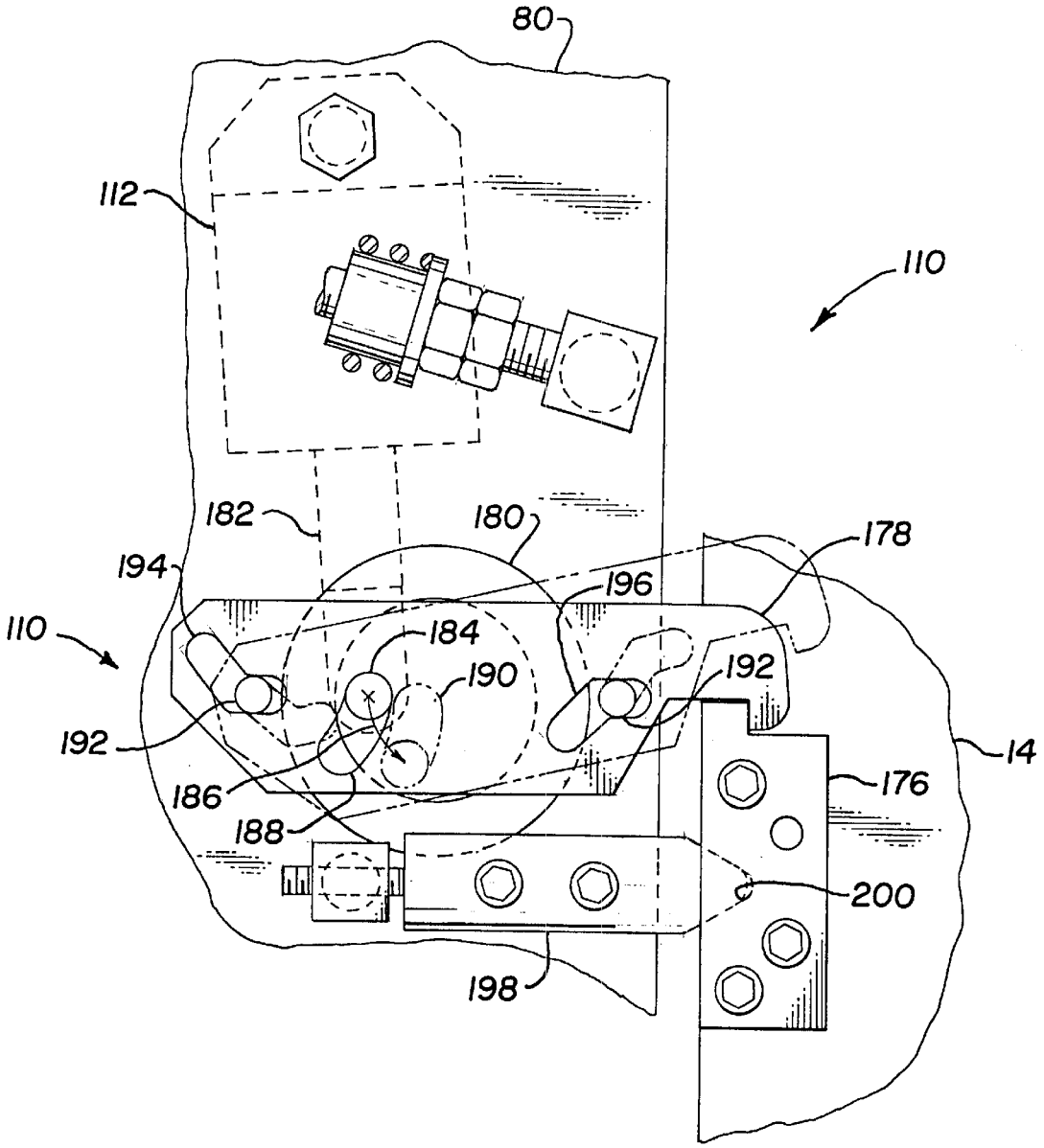
FIG. 8 is a cut away side view of a locking mechanism that holds the printing head of the printer-coater rigid to the frame, including an adjustable stop with cooperates with the lock to stabilize the printing head.

FIG. 8 discloses essential features of locking mechanism 110 which may be referred to as a latch or a latching mechanism. Mechanism 110 is mounted on secondary frame 80 and latches to a keeper 176 on press frame 14. Latching bar 178 is in solid line in the latched position with keeper 176 and in the dotted line position when it is moved to the unlatched position. Air cylinder 112 mounted to frame 80 drives a circular operator 180 by means of piston rod 182 which causes operator 180 to rotate by means of a connection to the piston rod. Rotation of operator 180 moves pin 184 along the path indicated by the arrow 186. This causes slot 188 and the elongated latching bar 178 to move to the dotted line position indicated as 190. A pair of guide pins 192 mounted to the frame cooperate respectively with slots 194 and 196 to tilt and move latch 178 between the latched and unlatched position in response to movement of the rod connected to cylinder 112. Finally, adjustable rest 198 bolted to frame 80 repeatably positions frame 80 with respect to press frame 114 by rigid contact with positioning opening 200 in keeper 176. The latch has no tendency to hang up because it moves forwardly and upwardly when unlocking printing head 58 from press frame 14.

Figure 9:
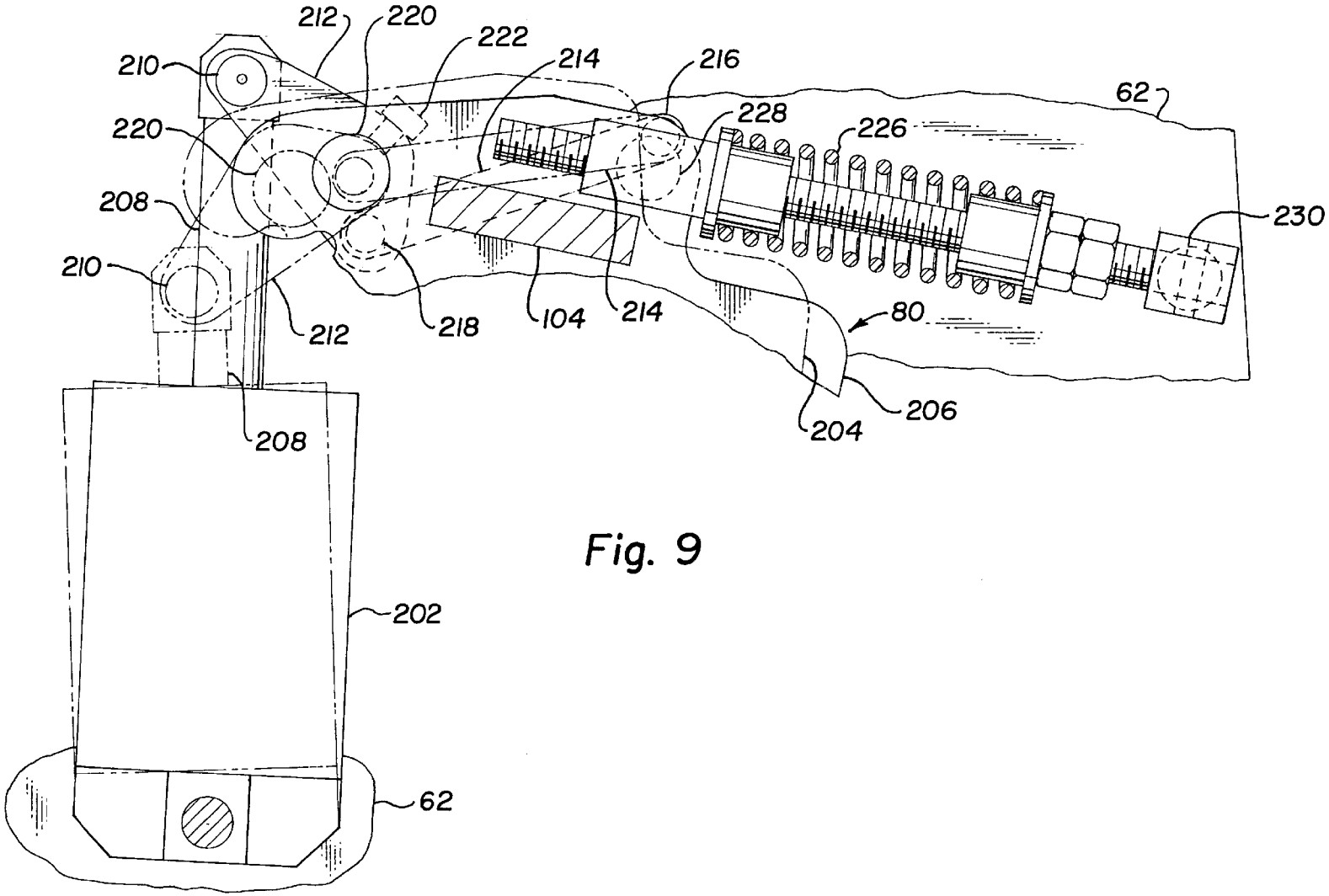
FIG. 9 is a cut away side view of one of the air cylinders which moves the printing cylinder of the printer-coater into printing contact with the impression cylinder of the press showing a spring mounted in cooperation with the linkage.

FIG. 9 discloses a mechanism for moving plate cylinder 81 on and off impression with impression cylinder 36 of the lithographic printing station on which the apparatus is mounted. Air cylinder 202 is pivotally connected to main frame 62. There is one mounted on the operator side as well as the drive side as indicated in FIG. 3. The movement of frame 80 as a result of this mechanism can be seen in the dotted outline "off impression" position 204 of frame 80 and the linkage and the solid line "on impression position" 206 of frame 80. Piston rod 208 has a pivotal connection 210 with link member 212, which is a moveable link. A fixed link 214 has one end 216 connected to main frame 62 through fixed pivot 216. The opposite end of fixed link 214 is connected at pivot 218 to link member 212 at the end opposite its pivotal connection with the air cylinder. Intermediate pivoting connections 210 and 218, link 212 is fixedly mounted on the end of shaft 220 by means of connection device 222 which might take the form of a set screw. There is a clearance slot 224 in frame 62 for movement of shaft 220. Shaft 220 moves frame 80 in response to operation of air cylinder 202. The shaft 220 is fixed in frame 80 by means of journals. It is the secondary frame 80 which pivots on pivot point "P". Shaft 220 ties the operation of the two cylinders together so that frame 80 moves smoothly without "cocking" when moving between the on impression and off impression position of cylinder 81 with cylinder 36. FIG. 9 also indicates the use of a safety spring connected at connection 228 to movable frame 80 and at connection 230 to main frame 62. It provides an off movement action for the plate cylinder should there be a force imposed at the nip between plate cylinder 81 and impression cylinder 36 as by a foreign object to provide some "give" in the apparatus to avoid major damage if there is a "crash".

Figure 10:
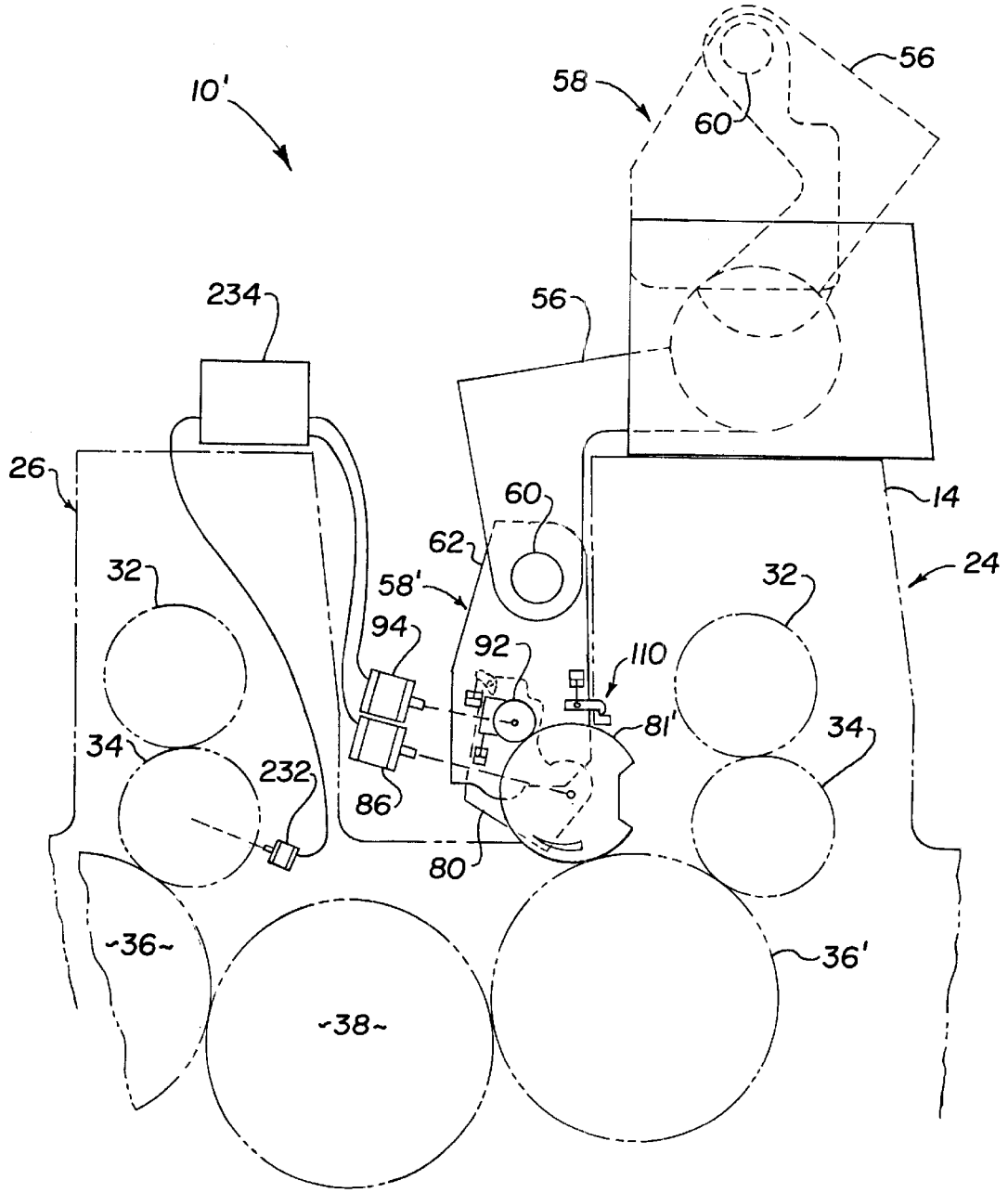
FIG. 10 is a schematic side view of the control elements for the printer-coater of the previous Figures illustrating that the printing plate cylinder of the printhead can also be applied to presses with multi-sided impression cylinders.

FIG. 10 is a schematic representation of a control system for the invention indicated generally by the reference numeral 10'. Some of the transfer cylinders between stations 24 and 26 have been removed in order to fit two printing stations on the page. It should be considered that stations 24 and 26 have the same number of transfer cylinders as shown in FIG. 1. One variation of the printhead 58' in FIG. 10 is that plate cylinder 81' is shown as being a smaller multiple of the diameter of the larger impression cylinder 36'. The circumference of the plate cylinder can be smaller than the impression cylinder.

A conventional motion control encoder 232 continually monitors the angular rotational position and speed of a register controlled cylinder on the printing press. In this case, encoder 232 is mounted to monitor the rotational angular position of a blanket cylinder 34. Since all of the main cylinders of lithographic printing press 12 are conventionally gear driven at a controlled pitch diameter to provide precise registration, any such cylinder can be monitored with the encoder. Encoder 232 is operationally electrically connected to a control unit 234 which in turn is electrically and operationally connected to servomotor 86 driving plate cylinder 81, 81' and variable speed electric motor 94 driving anilox roller 92. Encoder controlled drive motor 86 precisely drives and maintains the angular rotational position of plate cylinder 81, 81' in registration with the register controlled driven cylinders of the press. Servomotor 86 is preferably geared at about a 10:1 ratio to plate cylinder 81, 81' such that the motor turns tens times as fast as the plate cylinder turns. Control unit 234 includes a jog function that allows the operator to jog the plate cylinder for purposes of make ready. Encoder 232 senses the speed of the press and feeds control signals through the control box 234 to servomotor 86 in order to maintain its speed in registration with the speed of the driven press cylinders. It is also minutely electronically adjustable to adjust running register of plate cylinder 81, 81' so that register printing can be accomplished.

Anilox roller 94 may also be driven in response to the encoder through control box 234 by means of a carefully controlled variable speed motor which does not have to be as precise as the servomotor 86 driving plate cylinder 81, 81'. The anilox roller rotational speed can vary as much as +/− about 8% from the speed of the plate cylinder printing surface to which it is transferring printing liquid without causing ill effects. In some cases it is actually desirable to have a slight mismatch between the speed of anilox roller 92 and the speed of the plate cylinder. The variable speed anilox roller drive motor could be driven by a tachometer generator to track the speed of the press rather than a more expensive encoder servomechanism which is required for the precise register control printing using the plate cylinders 81, 81'.

Control box 234 can be electrically tied into the press operator control panel so that the operator can monitor and control the printer-coater remotely. Although not shown, a sensor would be provided in connection with operation of air cylinder 202 which moves the cylinder to the on or off impression position, to sense when the last sheet has reached impression cylinder 36 to throw off the impression to avoid printing on a bare cylinder. It is believed that the preferred encoder is sold under the trade name "Ormec" line shaft PACER™ Encoders by Ormec Systems, Corp., 19 Linden Park, Rochester, N.Y. 14625. The Ormec PACER™ encoder system measures real time shaft position data of a machine axis to be sent to other servo axes in the system in what is known in the art as "electronic gearing". The preferred position encoder is believed to be line shaft PACER™ encoder EDR-25S, B5000, available as indicated from Ormiec. Also from Ormec is a single axis digital signal processor and pacer model ORN-DSP-A0/2, an AC servomotor for driving the anilox roller MAC-DE011C2/1(4500 rpm max) and an AC servomotor MAC-DB100P/1(3000 rpm max) together with cables and software. Ormec is accessible on the Internet at Ormec dot com.

Figure 11:
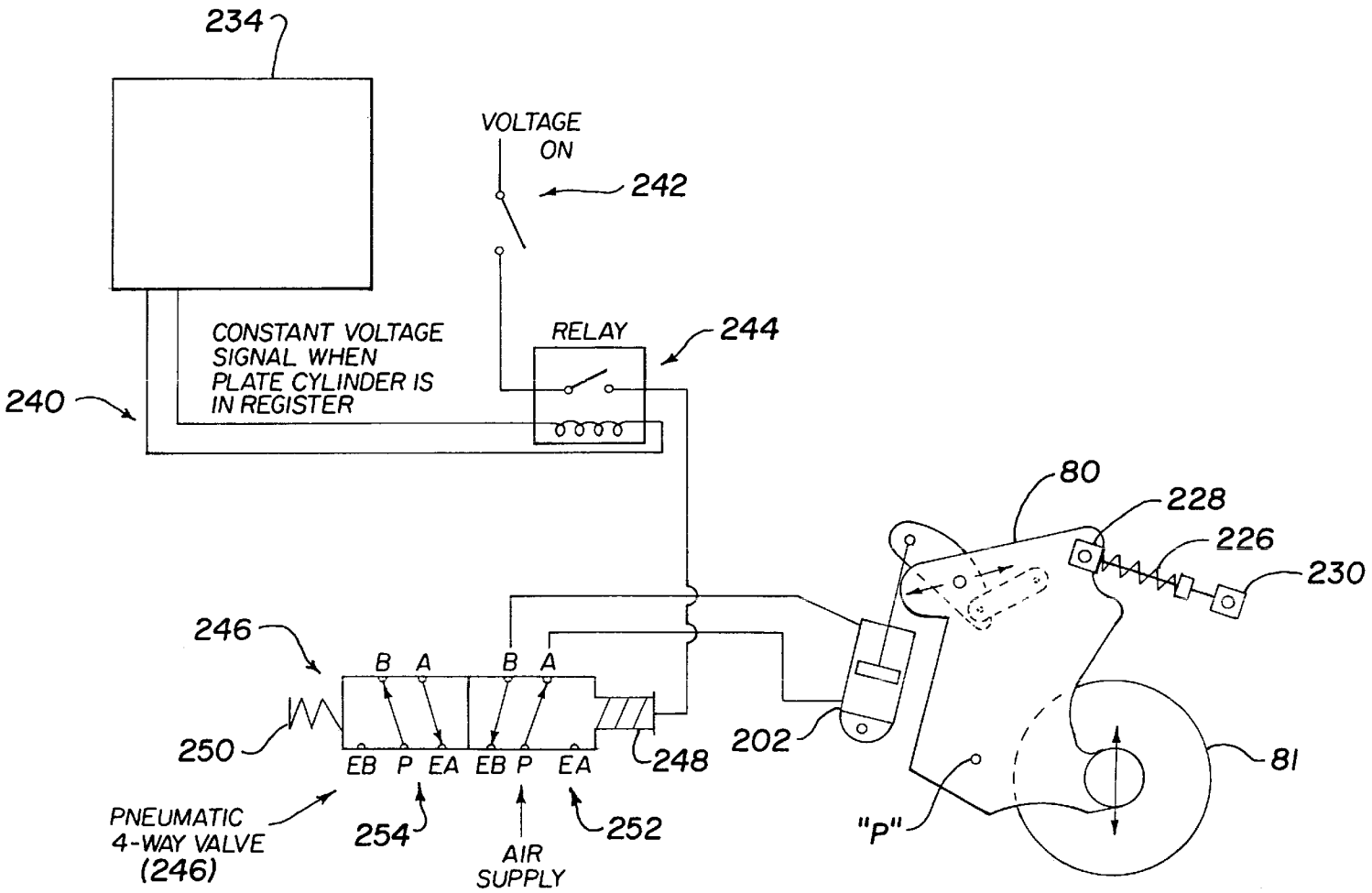
FIG. 11 is a schematic representation of an additional safety feature which reacts to an interruption or change in a constant voltage signal which represents the plate cylinder being in register by quickly unloading the plate cylinder to avoid damage should register be lost.

FIG. 11 schematically shows a preferable safety control which immediately moves plate cylinder 81 (or 81') out of impression with impression cylinder 36 should register between these cylinders be lost. A constant voltage signal 240 is generated and monitored by control unit 234 when plate cylinder 81 is in impression with impression cylinder 36 and running in register. The signal can actually be present before impression since the cylinders 81 and 36 are actually turning in printing registration even before impression. The system can be energized by switch 242 which applies power to relay 244 connected to four way pneumatic valve 246. Valve 246 is preferably a "spool" valve which has a "spool" 248 and a spring 250. Four-way valve 246 is connected to air cylinder 202 which in one first position 252 of the four-way valve continues to apply air pressure (does not disrupt the cylinder pressure) when signal 240 remains unaltered at a predetermined condition (i.e., constant voltage). Four-way valve 246 is represented as a first position 252 on the right side of the vertical line and a second position 254 on the left side of the vertical line. In FIG. 11, "P" represents pressurized air, "A" represents on impression pressure in air cylinder 202, while "B" represents off impression pressure at the air cylinder 202. The symbols EA and EB represent "exhaust" A or B. Therefore, if the constant signal 240 found to be altered by control unit 234, relay 244 is energized and valve 246 shifts to the second position which dumps impression pressure A to exhaust EA. At the same time, air P is applied to off impression pressure B which drives the piston of air cylinder 202, moving the link and instantly returning plate cylinder 81 to its off impression position. This action occurs instantly and without any input from the press operator. This action prevents damage resulting from unregistered impression of cylinders 36, 81 until the abnormal condition that produced the change in signal 240 reflecting a problem somewhere in the system is corrected. This system can easily be set up so that the unenergized state of the relay provides the first position 252 of valve 246 and requires electrical power, so that a power failure will automatically and certainly cause the four-way valve to move to the 254 off impression position.

Figure 12:
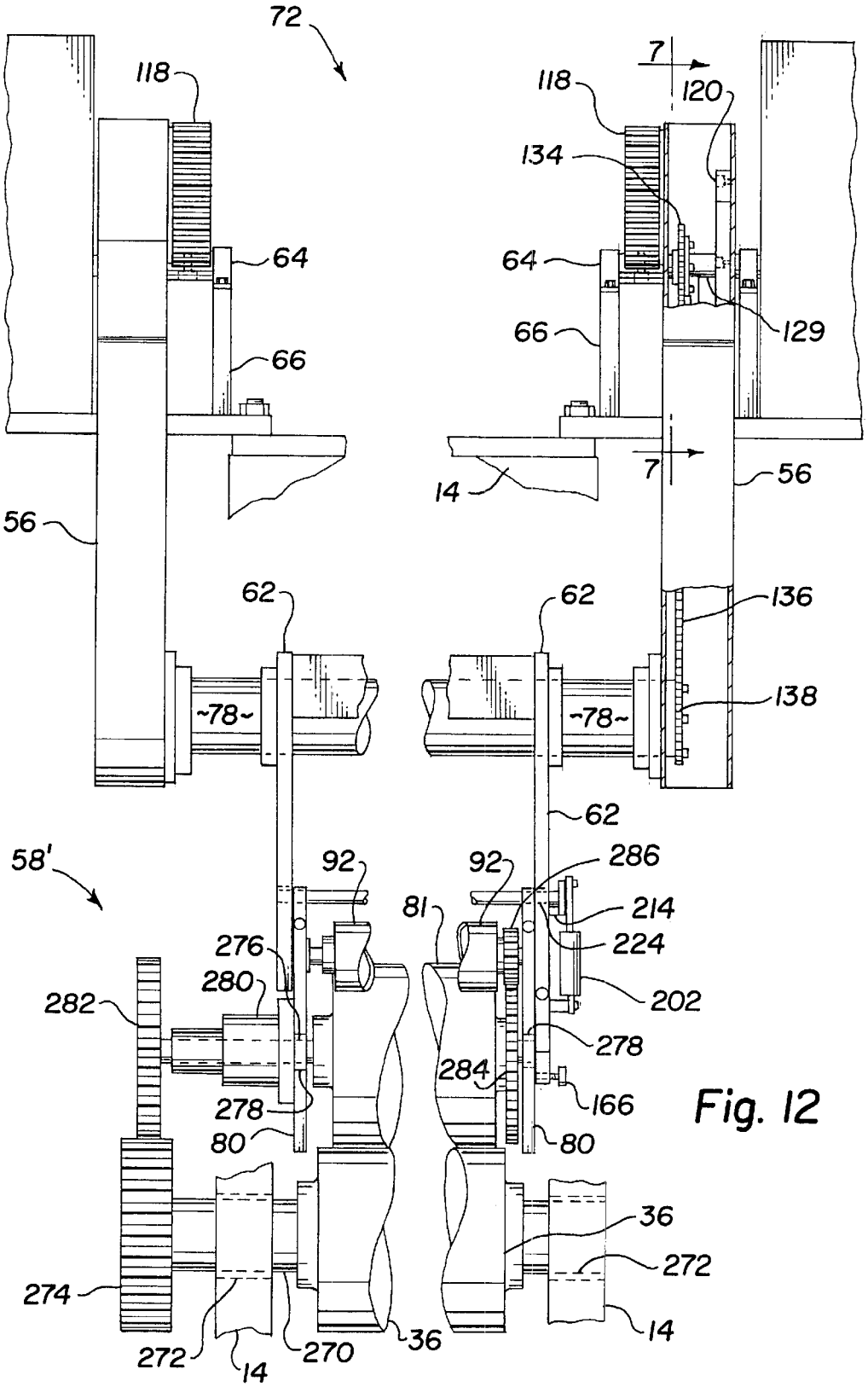
FIG. 12 is an elevation view of an alternate embodiment of the printer-coater being driven by press gears which register the press cylinders for printing.

FIG. 12 illustrates an alternative printer-coater 10 having flexographic printing head 58' being driven for register printing by means of gears. It will be understood that some parts having the same reference numbers as FIGS. 2 and 3 may be modified somewhat in a manner not hard to understand to accommodate the gear drive. Since drive power will be taken from the press itself, the drive motors 86 and 94 and the associated belts and pulleys will not be present.

Impression cylinder 36 has an axial shaft 270 which is journaled for rotation in frame 14 by journals 272. A press drive gear 274 is fixed to shaft 272. Although press drive gear 274 is shown outside part of frame 14, in actuality it is in the frame and drivingly connected to turn with all the registered cylinders on the press. It may be accessed through a cover (not shown) in the press frame in some cases.

Plate cylinder 81 is fixed on a shaft 276 which is journaled for rotation in secondary frame 80. One end of shaft 276 has a journal bearing 278 while the other end of shaft 276 extends through a bearing 278 and a collar 280 attached to frame 80. The outer end of shaft 276 has a properly sized drive gear 282 to mesh with gear 274 and thereby drive plate cylinder 81 in printing registration with impression cylinder 36. The gear teeth are preferably deep enough to allow plate cylinder 81 to move on and off impression with impression cylinder 36 when secondary frame 80 is moved relative to main frame 62 in the manner previously described without becoming entirely disengaged. Of course, when the printing head is fully retracted, it means that index teeth on gears 274, 282 must be re-engaged in the manner described in U.S. Pat. 5,178,678 before normal printing operations can be performed.

In addition, plate cylinder 81 may have a secondary drive gear 284 opposite drive gear 282 which is used to mesh with drive gear 286 fixed on the shaft which supports anilox roller 92 for rotation in register with plate cylinder 81. These gears should allow for some movement of the anilox roller away from the printing surface of plate cylinder 81 so that application of ink or other printing liquid can be suspended without losing engagement of the gear teeth. This is not as critical since the anilox roller has no definite angular position relative to the plate cylinder although it should rotate at about the same surface speed. The anilox roller could also be driven by the servomotor as illustrated in the preferred embodiment instead of being gear driven. Appropriate guards would cover exposed gears as necessary for operator safety. The gear driven embodiment could advantageously employ all the features of the preferred embodiment that do not require the servomotor and control system which drive the plate cylinder.

In operation LITHOFLEX I™ printer-coater adds an additional printing function to any lithographic printing station 22–28, on exemplary press 12. Plate cylinder 81 is similar to a conventional plate cylinder used on a lithographic press. It has means for wrapping a plate around the surface and holding it in position for flexographic printing. A relief plate has "raised" printing areas (relative to other areas) which constitute the printing surface and which receive a layer of ink from anilox roller 92 in printhead 58. Due to the direction of rotation of the lithographic press impression cylinder 36, and the position of printhead 58, a station such as station 24, for example, lithographically prints the surface of a succession of sheets F as they pass between blanket cylinder 34 and impression cylinder 36 in station 24. As the sheet continues along the path line, after the nip between cylinders 34 and 36, it is directly printed on by means of plate 84 (or a blanket) on plate cylinder 81.

A heavier layer of wet film forming ink is applied by the flexographic process than by the lithographic process, for example, which can apply a layer of opaque or colored ink in desired image areas on the substrate. This may be referred to as "spot" printing wherein the flexographic images are placed around or over the lithographic images. Colored inks, such as gold, can provide special affects as can metallic pigmented inks. Better color density results from direct contact of printing plate 84 on the substrate as well as from the characteristics of flexographic printing and coating. The only wet film splitting that occurs is between the plate and substrate itself. Since the LITHOFLEX I™ unit is installable on multi-station presses at interstation positions, substrates passing through the printing station having the printer-coater of the invention can then be overprinted by the lithographic process on the next or several succeeding printing stations or perfected and printed on the other side. All this is done without losing the color printing capability of any printing station. As a safety feature, when the printing head is lowered into position for printing, the control system is interlocked to ensure that plate cylinder 81 is rotating with the registered press cylinders before it can be moved to the on impression position with cylinder 36.

Of equal advantage is the application of a smooth overall coating or a spot coating with a clear or transparent colored film of ink produced with a smooth blanket mounted on the plate cylinder of the LITHOFLEX I™ printer-coater. Some techniques are known for effectively raising portions of the blanket in order to apply a coating to specific areas and not to others, but in most cases the blanket would simply apply an overall coating film to the printed surface of the lithographically printed sheet. This surface can be dried through use of fast drying inks before overprinting with lithographic ink in a following station. Such a coating can be applied as a protective coating, decorative coating or a spot coating applied with a printing plate. Application of an overall coating is especially advantageous in connection with the operation of a perfecting press or a "long" perfecting press which may have four printing units before the perfecting apparatus and four printing stations after the perfecting apparatus. When applied to a perfecting lithographic printing press, the LITHOFLEX I™ printer-coater can apply an overall protective coating to the lithographic colors that are printed ahead of the perfecting apparatus in order to protect that surface after the sheet is reversed to be printed on the other side. Preferably a dryer is employed after the coating and before the substrates reach the perfecting apparatus in order to seal in the lithographic ink. The overall coating that is applied can be a protective or a decorative coating.

It is also possible to employ a split pan and split applicator roller of the type shown in U.S. Pat. No. 5,651,316 to Howard W. DeMoore, which is incorporated herein by reference. The system disclosed therein allows the application of more than one type of coating or more than one color to be applied to each half of the sheets in one operation as they move through the press. A further advantage is that when parked, the printer-coater of the invention is completely out of the operator's way and in no way affects the conventional operation of the press in the usual manner. An additional advantage of the parked location of the printer-coater is that maintenance and make ready can be prepared while the press is still running another job because the operator has access to the plate cylinder from the interstation space on the other side of the station.

Those skilled in the art will appreciate that various modifications to the method and apparatus of the present invention may be made without departing from the scope of invention as defined in the appended claims.

I claim:

1. An impression cylinder printing apparatus which combines lithographic and flexographic printing on a substrate passing over the impression cylinder of a lithographic printing station in a one pass printing operation, comprising:

an offset lithographic printing press having a plurality of successive offset lithographic printing stations having an impression cylinder and a substrate path whereby a substrate is supported for printing on the impression cylinder;

a retraction mechanism mounted on any printing station of the press and a flexographic printing head coupled to the retraction mechanism for movement between a storage position and an operating position of the printing head;

the printing head comprising a plate cylinder having a printing surface thereon mounted in a frame in operative combination with a roller mechanism and an ink supply for applying a controlled layer of printing liquid to the printing surface, the printing head having an encoder controlled motor driving the plate cylinder of the printing head in registration with the impression cylinder; and apparatus for moving the plate cylinder of the printing head when in the operating position from an off impression condition to an on impression position with a substrate being supported on the impression cylinder of the printing station;

whereby a substrate moving across the impression cylinder at the printing station on which the printing head is located can be lithographically printed by the printing station and be flexographically printed by transferring a film of printing liquid from the printing surface to the substrate while it is still on the impression cylinder of the lithographic printing station.

2. The apparatus of claim 1 wherein the retraction mechanism comprises arms that raise and lower the printing head between the operating position and the storage position.

3. The apparatus of claim 2 wherein an operating apparatus for moving the arms of the retraction mechanism is elevated and mounted above said any printing station whereby the printing head is parked in the storage position in the space above said any printing station.

4. The apparatus of claim 3 wherein the operating apparatus for the retraction mechanism has a positioning drive which cants the printing head as it is being raised or lowered by the arms to miss the adjacent printing station.

5. The apparatus of claim 4 wherein the operating apparatus for moving the arms of the retraction mechanism includes a drive motor and speed control which varies the rotational speed of a shaft which moves the arms as the printing head is raised and lowered.

6. The apparatus of claim 4 wherein the speed control includes cams that turn when said arms are raised and lowered and switches that slow the drive motor for the arms and stops the arms as the printing head approaches its operating and storage positions.

7. The apparatus of claim 2 wherein the frame on which the printing head is mounted comprises a main part connected to the arms of the retraction mechanism and a movable secondary part connected to the main part wherein the secondary part carries the plate cylinder and roller mechanism for applying a controlled layer of printing liquid to the printing surface.

8. The apparatus of claim 7 wherein the main part releaseably locks onto the press frame when the printing head is moved to the operating position by the retraction mechanism.

9. The apparatus of claim 7 wherein the secondary part of the frame pivots relative to the main part of the frame in response to an activator to move the plate cylinder of the print head on and off impression with the impression cylinder of the lithographic printing station.

10. The apparatus of claim 1 having a control unit for registering the printing surface of the printing head with the impression cylinder which comprises an encoder which monitors rotational position of a register controlled cylinder on the lithographic press, in combination with the encoder operated drive motor which positively drives the printing head plate cylinder.

11. The apparatus of claim 10 wherein the control unit monitors a signal representing satisfactory registration of the plate cylinder with the impression cylinder and includes apparatus that automatically drives the apparatus for moving the plate cylinder of the printing head to the off impression position in response to signal variation.

12. The apparatus of claim 11 wherein the apparatus for moving the plate cylinder and the apparatus for automatically driving said plate cylinder moving apparatus are pneumatic.

13. The apparatus of claim 1 wherein a control unit for registering the printing surface of the printing head with the impression cylinder comprises an encoder which monitors rotational position of a register controlled cylinder on the lithographic press in combination with an encoder controlled drive motor which positively drives the printing head plate cylinder.

14. The apparatus of claim 13 wherein the printing surface is the surface of a blanket mounted on the plate cylinder of the printing head.

15. The apparatus of claim 14 further including a substrate having a lithographic image printed by the station on which the printing head is positioned and an overcoated film of printing liquid applied by the printing surface of the blanket on the plate cylinder of the printing head directly onto the substrate while it is on the impression cylinder of said station.

16. The apparatus of claim 13 wherein the printing surface is a relief plate mounted on the plate cylinder of the printing head.

17. The apparatus of claim 16 further including a substrate having a lithographic image printed by the station on which the printing head is positioned and an overcoated film of printing liquid applied by the printing surface of the relief plate on the plate cylinder of the printing head directly onto the substrate while it is on the impression cylinder of said station.

18. The apparatus of claim 17 wherein the relief plate is a flexographic plate and the printing liquid is flexographic ink being transferred to the substrate on the impression cylinder.

19. The apparatus of claim 14 wherein the lithographic printing press is a perfecting press having a perfecting apparatus and the printing head is mounted on the printing station just before the perfecting apparatus to overcoat the lithographically printed surface of the substrate before it is perfected.

20. The apparatus of claim 19 wherein a dryer is positioned to dry the overcoated substrate before it is perfected.

21. A retractable impression cylinder printing apparatus adapted for interstation installation on an offset lithographic printing press having a plurality of successive printing stations for printing color images on a succession of substrates in a continuous in-line process, the retractable impression cylinder printing apparatus comprising:

a printing head comprising a driven plate cylinder having a printing surface mounted in a frame in operative combination with a roller mechanism and an ink supply for applying a controlled layer of printing liquid to the printing surface;

a retraction mechanism which supports the printing head at an interstation location for movement between an operating position wherein the printing surface can be moved to an on impression position with the impression cylinder of one printing station and a storage position in which the printing head is removed from the space between the one printing station and the next printing station;

a control unit which registers the printing surface of the printing head with said impression cylinder by means of an encoder controlled motor on the printing head driving the plate cylinder;

whereby the printing surface can register print successive substrates on the impression cylinder of one station on the lithographic press without affecting the capability of that press station to print the succession of substrates by offset lithography and whereby at least one downstream printing station can print on the succession of substrates.

22. The apparatus of claim 21 wherein the retraction mechanism comprises arms that raise and lower the printing head between the operating position and the storage position.

23. The apparatus of claim 22 wherein an operating apparatus for moving the arms of the retraction mechanism is elevated and mounted above said one station whereby the printing head is parked in the space above said one station in the storage position.

24. The apparatus of claim 23 wherein the operating apparatus for the retraction mechanism has a positioning drive which cants the printing head as it is being raised or lowered by the arms to miss said next printing station.

25. The apparatus of claim 24 wherein the operating apparatus for moving the arms of the retraction mechanism includes a drive motor and speed control which varies the rotational speed of a shaft which moves the arms as the printing head is raised and lowered.

26. The apparatus of claim 25 wherein the speed control includes cams that turn when said arms are raised and lowered and switches that slow the drive motor for the arms and stops the arms as the printing head approaches its operating and storage positions.

27. The apparatus of claim 22 wherein the frame on which the printing head is mounted comprises a main part connected to the arms of the retraction mechanism and a movable secondary part connected to the main part wherein the secondary part carries the plate cylinder and roller mechanism for applying a controlled layer of printing liquid to the printing surface.

28. The apparatus of claim 27 wherein the main part releaseably locks onto the press frame when the printing head is moved to the operating position by the retraction mechanism.

29. The apparatus of claim 27 wherein the secondary part of the frame pivots relative to the main part of the frame in response to an activator to move the plate cylinder of the print head on and off impression with the impression cylinder of the lithographic printing station.

30. The apparatus of claim 29 wherein the control unit for registering the printing surface of the printing head with the impression cylinder comprises an encoder which monitors rotational position of a register controlled cylinder on the lithographic press, in combination with the encoder controlled drive motor which positively drives the printing head plate cylinder.

31. The apparatus of claim 21 further including an activator connected to move the plate cylinder on and off impression wherein the control unit generates constant signal representation of correct registration of the plate cylinder and automatically triggers the activator to move the plate cylinder to its off impression position if said signal does not remain constant.

32. The apparatus of claim 31 wherein the activator is pneumatically operated by a control valve having a non-powered position and a powered position where the powered position corresponds to the activator having moved the plate cylinder on impression and the non-powered position corresponds to the activator having moved the plate cylinder off impression and the control valve is configured in the non-powered position to move the activator to the off impression position of the plate cylinder in event of a power failure.

33. The apparatus of claim 21 wherein the control unit for registering the printing surface of the printing head with the impression cylinder comprises an encoder which monitors rotational position of a register controlled cylinder on the lithographic press in combination with the encoder controlled drive motor which positively drives the printing head plate cylinder.

34. The apparatus of claim 33 further including an activator connected to move the plate cylinder on and off impression wherein the control unit generates constant signal representation of correct registration of the plate cylinder and automatically triggers the activator to move the plate cylinder to its off impression position if said signal does not remain constant.

35. The apparatus of claim 34 wherein the activator is pneumatically operated by a control valve having a non-powered position and a powered position where the powered position corresponds to the activator having moved the plate cylinder on impression and the non-powered position corresponds to the activator having moved the plate cylinder off impression and the control valve is configured in the non-powered position to move the activator to the off impression position of the plate cylinder in event of a power failure.

36. A lithographic printing press having a plurality of lithographic printing stations for printing color images on the surface of a succession of substrates moving through the press on a substrate path of the press, the printing stations having plate, blanket and impression cylinders together with inking apparatus for lithographic printing, the improvement comprising:

a printing head comprising a driven plate cylinder having a printing surface and an anilox roller mounted in a frame and coupled in operative combination with a supply of printing liquid;

retractable mounting structure connected to support the printing head for movement between an unretracted position and a retracted position;

the printing head being mounted in the space between an upstream printing station and a following printing station for movement between an on impression and an off impression position relative to the impression cylinder of the upstream printing station;

an adjustable control unit which synchronizes rotation of the plate cylinder of the printing head with rotation of the impression cylinder of the lithographic printing station by means of a controlled servomotor driving the plate cylinder;

whereby the printing surface on the plate cylinder of the printing head can register print or spot coat the substrates on the impression cylinder before they are transferred to the following printing station for a subsequent printing operation.

37. The apparatus of claim 36 wherein the control unit monitors a signal representing satisfactory registration of the plate cylinder with the impression cylinder and includes a device which moves the plate cylinder between the on impression and off impression positions which is automatically triggered to move the plate cylinder off impression if the signal representing satisfactory registration of the plate cylinder with the impression cylinder is altered.

38. A retractable impression cylinder printing apparatus adapted for installation on an upstream printing station of an offset lithographic printing press having at least one following downstream in line lithographic printing station wherein the lithographic printing stations have a frame having a driven plate cylinder, blanket cylinder and impression cylinder including inking rollers for offset lithography, the retractable impression cylinder printing apparatus comprising:

a printing head comprising a driven plate cylinder having a printing surface and anilox roller coupled in operative combination with an ink supply, the printing head being mounted in a frame adapted to allow the printing surface of the plate cylinder to be in impression contact with successive substrates passing around the impression cylinder of said upstream printing station;

a retraction mechanism supporting the printing head, which is movable between an operating position of the printing head for impression contact with said succession of substrates passing over the impression cylinder of the upstream printing station and a storage position in which the printing head is removed from the space between the upstream and following printing stations to provide operator access to the space when the impression cylinder printing apparatus is not in use;

a control unit capable of synchronizing rotation for register printing of the plate cylinder of the printing head with rotation of the impression cylinder in the upstream printing station by controlling a motor driving said plate cylinder, whereby the printing surface on the printing head plate cylinder can register print successive substrates on the impression cylinder of the upstream printing station while they are being printed on the upstream printing station and the downstream printing unit is processing the succession of substrates in line.

39. A method of printing which combines lithographic and flexographic printing in a continuous in-line process; comprising:

providing an offset lithographic printing press having a plurality of successive offset lithographic printing stations with a substrate path for printing color images on a series of substrates moving along the substrate path;

equipping a given offset lithographic printing station with a retractable flexographic printing head having an encoder controlled motor driving the plate cylinder and an inking system for printing liquid wherein the plate cylinder is mounted for movement on and off impression with the impression cylinder of said given offset printing station;

moving a series of substrates along the substrate path;

offset lithographically printing a surface of the series of substrates in a printing station of the press;

applying printing liquid directly on the lithographically printed surfaces of the series of substrates with the printing head as they are passing over the impression cylinder of the given station;

drying the overcoating applied by the printing head; and processing the series of substrates through another printing station of the press after they are dried.

40. The method of claim 39 wherein the plate cylinder of the printing head is provided with a blanket and the surfaces of the series of substrates are overcoated by impression with said blanket on the plate cylinder of the flexographic printing head while being supported on the impression cylinder of the given station.

41. The method of claim 39 wherein the plate cylinder of the printing head is provided with a relief plate and the step of applying an overcoating comprises the step of applying a spot coating with the relief plate directly onto selected areas of the surfaces of the substrates while they are being supported on the impression cylinder.

42. The method of claim 39 wherein the plate cylinder of the printing head is provided with a flexographic plate and ink and the step of applying an overcoating with the printing head comprises the step of applying flexographic ink images directly onto the surfaces of the substrates while they are being supported on the impression cylinder.

43. The method of claim 39 wherein:

the step of providing an offset lithographic printing press comprises the step of providing a perfecting press with at least one offset lithographic station before and after perfecting apparatus on the press;

the step of equipping a given station with a retractable printing head comprises the step of equipping an offset lithographic station with a retractable printing head ahead of the perfecting apparatus; and the steps of offset lithographically printing a surface of the series of substrates and the step of applying printing liquid directly on the lithographically printed surfaces of the substrates with the printing head are both performed on the same given printing station.

44. The method of claim 43 wherein the plate cylinder of the printing head is mounted with a relief plate and the step of applying an overcoating with the printing head comprises the step of applying a spot coating with the relief plate directly onto the lithographically printed surfaces of the substrates while they are being supported on the impression cylinder.

45. The method of claim 43 wherein the plate cylinder of the printing head is provided with a flexographic plate and ink and the step of applying an overcoating with the printing head comprises the step of applying flexographic ink images directly onto the surfaces of the substrates while they are being supported on the impression cylinder.

46. An impression cylinder printing method for interstation register printing or spot coating substrates on the impression cylinder of a printing station on an offset lithographic press, comprising the steps of:

providing a plurality of successive printing stations for printing color images on a succession of substrates, the printing units including an upstream lithographic printing station and a following downstream lithographic printing station wherein the upstream printing station includes a plate, blanket and impression cylinder together with inking apparatus for lithographic printing;

providing a printing head comprising a driven plate cylinder having a printing surface and an anilox roller mounted in a frame and coupled in operative combination with a supply of printing ink;

mounting the printing head at the upstream printing station in the space between the upstream printing station and a following printing station for movement between an on impression and an off impression position relative to the impression cylinder of the upstream printing station;

providing an adjustable control unit which synchronizes for register printing rotation of the plate cylinder of the printing head with rotation of the impression cylinder of the lithographic printing station by means of a controlled servomotor driving the plate cylinder;

moving a succession of substrates along a substrate path for the lithographic press;

moving the printing head to the on impression position;

register printing or spot coating substrates on the impression cylinder by means of the printing surface on the plate cylinder of the printing head and transferring the substrates to the following printing station for a subsequent lithographic printing operation.

47. The method of claim 46 further including the step of providing a dryer and using the dryer to dry the substrate before it is transferred to the following lithographic printing station.

48. The method of claim 46 further including the steps of generating and monitoring a signal representing a satisfactory state of registration of the plate cylinder with the impression cylinder and moving the plate cylinder off impression in response to alteration of said signal in a manner that indicates a lack of correct registration of the plate cylinder with the impression cylinder or power failure.

49. An impression cylinder printing apparatus which combines lithographic and flexographic printing on a substrate passing over the impression cylinder of a lithographic printing station in a one pass printing operation, comprising:

an offset lithographic printing press having a plurality of successive offset lithographic printing stations having an impression cylinder and a substrate path whereby a substrate is supported for printing on the impression cylinder;

a retraction mechanism mounted on a printing station of the press and a flexographic printing head coupled to the retraction mechanism for movement to an impression position of the printing head with the impression cylinder;

the printing head comprising a driven plate cylinder having a printing surface thereon mounted in a frame in operative combination with a roller mechanism and an ink supply for applying a controlled layer of printing liquid to the printing surface, the printing head being driven in printing registration with the impression cylinder; and apparatus for moving the plate cylinder of the printing head between an off impression condition and an on impression position with a substrate being supported on the impression cylinder of the printing station;

whereby a substrate moving across the impression cylinder at the printing station on which the printing head is located can be lithographically printed by the printing station and be flexographically printed by transferring a film of printing liquid from the printing surface to the substrate while it is still on the impression cylinder of the lithographic printing station.

50. The apparatus of claim 49 wherein the retraction mechanism comprises arms for moving the printing head.

51. The apparatus of claim 50 wherein the frame on which the printing head is mounted comprises a main part connected to the arms of the retraction mechanism and a movable secondary part connected to the main part wherein the secondary part carries the plate cylinder and roller mechanism for applying a controlled layer of printing liquid to the printing surface.

52. The apparatus of claim 51 wherein the main part releaseably locks onto the press frame when the printing head is moved to an operating position by the retraction mechanism.

53. The apparatus of claim 51 wherein the secondary part of the frame pivots relative to the main part of the frame in response to an activator to move the plate cylinder of the print head on and off impression with the impression cylinder of the lithographic printing station.

54. The apparatus of claim 50 wherein an operating apparatus for moving the arms of the retraction mechanism is elevated and mounted above said printing station whereby the printing head is parked in a storage position in the space above said printing station.

55. The apparatus of claim 54 wherein the operating apparatus for the retraction mechanism has a positioning drive which cants the printing head as it is being moved by the arms to miss the adjacent printing station.

56. The apparatus of claim 55 wherein the operating apparatus for moving the arms of the retraction mechanism includes a drive motor and speed control which varies the rotational speed of a shaft which moves the arms as the printing head is moved.

57. The apparatus of claim 56 wherein the speed control includes cams that turn when said arms are raised and lowered and switches that slow the drive motor for the arms and stops the arms as the printing head approaches its operating position.

58. The apparatus of claim 49 wherein the printing surface is the surface of a blanket mounted on the plate cylinder of the printing head.

59. The apparatus of claim 58 further including a substrate having a lithographic image printed by the station on which the printing head is mounted and an overcoated film of printing liquid applied by the printing surface of the blanket on the plate cylinder of the printing head directly onto the substrate while it is on the impression cylinder of said station.

60. The apparatus of claim 49 wherein the printing surface is a relief plate mounted on the plate cylinder of the printing head.

61. The apparatus of claim 60 further including a substrate having a lithographic image printed by the station on which the printing head is mounted and an overcoated film of printing liquid applied by the printing surface of the relief plate on the plate cylinder of the printing head directly onto the substrate while it is on the impression cylinder of said station.

62. The apparatus of claim 61 wherein the relief plate is a flexographic plate and the printing liquid is flexographic ink being transferred to the substrate on the impression cylinder.

63. The apparatus of claim 49 wherein the lithographic printing press is a perfecting press having a perfecting apparatus and the printing head is mounted on the printing station just before the perfecting apparatus to overcoat the lithographically printed surface of the substrate before it is perfected.

64. The apparatus of claim 63 wherein a dryer is positioned to dry the overcoated substrate before it is perfected.

65. A method of printing which combines lithographic and flexographic printing in a continuous in-line process; comprising:

providing an offset lithographic printing press having a plurality of successive offset lithographic printing stations with a substrate path for printing color images on a series of substrates moving along the substrate path;

equipping a given offset lithographic printing station with a retractable flexographic printing head having a plate cylinder and an inking system for printing liquid wherein the plate cylinder is mounted for movement on and off impression in printing registration with the impression cylinder of said given offset printing station;

moving a series of substrates along the substrate path;

offset lithographically printing a surface of the series of substrates in a printing station of the press;

applying printing liquid directly on the lithographically printed surfaces of the series of substrates with the printing head as they are passing over the impression cylinder of the given station;

drying the overcoating applied by the printing head; and processing the series of substrates through another printing station of the press after they are dried.

66. The method of claim 65 wherein the plate cylinder of the printing head is provided with a blanket and the surfaces of the series of substrates are overcoated by impression with said blanket on the plate cylinder of the flexographic printing head while being supported on the impression cylinder of the given station.

67. The method of claim 65 wherein the plate cylinder of the printing head is provided with a relief plate and the step of applying an overcoating comprises the step of applying a spot coating with the relief plate directly onto selected areas of the surfaces of the substrates while they are being supported on the impression cylinder.

68. The method of claim 65 wherein:

the step of providing an offset lithographic printing press comprises the step of providing a perfecting press with at least one offset lithographic station before and after perfecting apparatus on the press;

the step of equipping a given station with a retractable printing head comprises the step of equipping an offset lithographic station with a retractable printing head ahead of the perfecting apparatus; and the steps of offset lithographically printing a surface of the series of substrates and the step of applying printing liquid directly on the lithographically printed surfaces of the substrates with the printing head are both performed on the same given printing station.

69. The method of claim 68 wherein the plate cylinder of the printing head is mounted with a relief plate and the step of applying an overcoating with the printing head comprises the step of applying a spot coating with the relief plate directly onto the lithographically printed surfaces of the substrates while they are being supported on the impression cylinder.

* * * * *